US011225102B2

(12) United States Patent
Godfrey et al.

(10) Patent No.: US 11,225,102 B2
(45) Date of Patent: Jan. 18, 2022

(54) SECURITY DEVICE AND METHOD OF MAKING THEREOF

(71) Applicant: DE LA RUE INTERNATIONAL LIMITED, Basingstoke (GB)

(72) Inventors: John Godfrey, Basingstoke (GB); Rebecca Locke, Basingstoke (GB); Meagan De La Bastide, Basingstoke (GB)

(73) Assignee: DE LA RUE INTERNATIONAL LIMITED, Basingstoke (GB)

( * ) Notice: Subject to any disclaimer, the term of this patent is extended or adjusted under 35 U.S.C. 154(b) by 0 days.

(21) Appl. No.: 16/642,250

(22) PCT Filed: Aug. 28, 2018

(86) PCT No.: PCT/GB2018/052420
§ 371 (c)(1),
(2) Date: Feb. 26, 2020

(87) PCT Pub. No.: WO2019/043366
PCT Pub. Date: Mar. 7, 2019

(65) Prior Publication Data

US 2021/0070090 A1 Mar. 11, 2021

(30) Foreign Application Priority Data

Aug. 29, 2017 (GB) ..... 1713799

(51) Int. Cl.
*B42D 25/324* (2014.01)
*B42D 25/364* (2014.01)
(Continued)

(52) U.S. Cl.
CPC ..... *B42D 25/29* (2014.10); *B42D 25/324* (2014.10); *B42D 25/351* (2014.10);
(Continued)

(58) Field of Classification Search
CPC ..... B42D 25/324; B42D 25/364
See application file for complete search history.

(56) References Cited

U.S. PATENT DOCUMENTS 4,434,010 A 2/1984 Ash
5,059,245 A 10/1991 Phillips et al.
(Continued)

FOREIGN PATENT DOCUMENTS

DE 102007020026 A1 * 11/2007 ..... D21H 21/40
EP 0 059 056 A1 9/1982
(Continued)

OTHER PUBLICATIONS

Feb. 27, 2018 Combined Search and Examination Report issued in British Patent Application No. 1713799.3.
(Continued)

*Primary Examiner* — Kyle R Grabowski
(74) *Attorney, Agent, or Firm* — Oliff PLC

(57) ABSTRACT

A security device and method of making thereof. The security device includes a colour shifting element that exhibits different colours dependent on the angle of incidence of light impinging upon the colour shifting element, and; an at least partially transparent light control layer covering at least a part of the colour shifting element and including a surface relief adapted to modify the angle of light incident upon the light control layer, wherein; the light control layer includes at least first and second functional regions having different refractive indices such that light incident upon the first functional region impinges upon the colour shifting element at a first angle of incidence, and light incident upon the second functional region impinges upon the colour shifting element at a second, different, angle of incidence.

20 Claims, 12 Drawing Sheets

(51) Int. Cl.

| | |
|---|---|
| ***B42D 25/29*** | (2014.01) |
| *B42D 25/351* | (2014.01) |
| *B42D 25/355* | (2014.01) |
| *B42D 25/425* | (2014.01) |

(52) U.S. Cl.
CPC ..... *B42D 25/355* (2014.10); *B42D 25/364* (2014.10); *B42D 25/425* (2014.10)

(56) References Cited

U.S. PATENT DOCUMENTS

| | | | | |
|---|---|---|---|---|
| 5,084,351 | A | 1/1992 | Philips et al. | |
| 5,135,812 | A | 8/1992 | Phillips et al. | |
| 5,171,363 | A | 12/1992 | Phillips et al. | |
| 5,571,624 | A | 11/1996 | Phillips et al. | |
| 5,591,527 | A * | 1/1997 | Lu | B42D 25/29 428/411.1 |
| 7,903,308 | B2 * | 3/2011 | Commander | B44F 1/10 359/2 |
| 9,348,070 | B2 * | 5/2016 | Lister | B42D 25/355 |
| 2008/0018965 | A1 * | 1/2008 | Phillips | B42D 25/373 359/2 |
| 2009/0121473 | A1 * | 5/2009 | Camus | G07D 7/003 283/85 |
| 2010/0060987 | A1 * | 3/2010 | Witzman | G02B 5/286 359/589 |
| 2010/0270379 | A1 * | 10/2010 | Lister | B42D 25/364 235/487 |
| 2014/0268261 | A1 * | 9/2014 | Kubo | B42D 25/445 359/2 |
| 2017/0203601 | A1 * | 7/2017 | Yashiki | G02B 5/0284 |

FOREIGN PATENT DOCUMENTS

| | | | | |
|---|---|---|---|---|
| EP | 0 341 002 | A2 | 11/1989 | |
| EP | 0 668 329 | A2 | 8/1995 | |
| EP | 0 741 170 | A1 | 11/1996 | |
| EP | 0 723 501 | B1 | 7/1997 | |
| EP | 0 724 519 | B1 | 7/1997 | |
| EP | 0 736 073 | B1 | 3/1998 | |
| EP | 0 860 298 | A2 | 8/1998 | |
| EP | 1 114 102 | B1 | 9/2002 | |
| EP | 1 141 480 | B1 | 2/2004 | |
| EP | 1 398 174 | A1 | 3/2004 | |
| EP | 3 275 681 | A1 | 1/2018 | |
| GB | 2 454 752 | A | 5/2009 | |
| JP | 2011173379 | A * | 9/2011 | |
| WO | 83/00659 | A1 | 3/1983 | |
| WO | 00/39391 | A1 | 7/2000 | |
| WO | 03/054297 | A2 | 7/2003 | |
| WO | 03/095188 | A2 | 11/2003 | |
| WO | 2006/007742 | A1 | 1/2006 | |
| WO | 2013/022699 | A1 | 2/2013 | |
| WO | WO-2013022699 | A1 * | 2/2013 | B42D 25/29 |

OTHER PUBLICATIONS

Oct. 26, 2018 International Search Report issued in International Patent Application No. PCT/GB2018/052420.

Oct. 26, 2018 Written Opinion of the International Searching Authority issued in International Patent Application No. PCT/GB2018/052420.

Jun. 15, 2020 Office Action issued in British Patent Application No. 1713799.3.

* cited by examiner

SECURITY DEVICE AND METHOD OF MAKING THEREOF

FIELD OF THE INVENTION

The present invention relates to security devices suitable for use in security documents such as banknotes, identity documents, passports, certificates and the like, as well as methods for manufacturing such security devices.

BACKGROUND TO THE INVENTION

To prevent counterfeiting and to enable authenticity to be checked, security documents are typically provided with one or more security devices which are difficult or impossible to replicate accurately with commonly available means such as photocopiers, scanners or commercial printers.

One well known type of security device is one which uses a colour shifting element to produce an optically variable effect that is difficult to counterfeit. Such a colour shifting element generates a coloured appearance which changes dependent on the viewing angle. Examples of known colour shifting structures include photonic crystals, liquid crystals, interference pigments, pearlescent pigments, structured interference materials or thin film interference structures including Bragg stacks.

It is also known in the art that the optical effect produced by a colour shifting element can be modified by introducing a film comprising a surface relief over the colour shifting element, wherein the surface relief comprises a plurality of angled facets that refract the light incident to, and reflected from, the colour shifting element so as to provide a different optical effect to the viewer. For example, such an additional "light control layer" may produce colour shifting effects which are visible closer to a normal angle of viewing with respect to the device, and may enable more colours to be viewed on tilting the device as compared to the colour shifting element in isolation.

In order to increase the difficulty of counterfeiting such a security device, it is beneficial for the security device to exhibit more than one colour shifting effect. The amount of refraction of light by a surface relief positioned above a colour shifting element (and therefore the exhibited colour shifting effect) may be manipulated by using a surface relief having varying facet angles. The use of different facet angles allows for different amounts of refraction and, correspondingly, different colour shifting effects. However, although this is beneficial for security, it is difficult, time consuming and costly to produce a surface relief having a plurality of different facet angles.

SUMMARY OF THE INVENTION

In accordance with a first aspect of the invention there is provided a security device comprising: a colour shifting element that exhibits different colours dependent on the angle of incidence of light impinging upon the colour shifting element, and; an at least partially transparent light control layer covering at least a part of the colour shifting element and comprising a surface relief adapted to modify the angle of light incident upon the light control layer, wherein; the light control layer comprises at least first and second functional regions having different refractive indices such that light incident upon the first functional region impinges upon the colour shifting element at a first angle of incidence, and light incident upon the second functional region impinges upon the colour shifting element at a second, different, angle of incidence.

The inventors have realised that they can provide a security device that provides a striking visual effect to a viewer through a combination of the optical effects generated by the colour shifting element and the surface relief of the light control layer. Particularly advantageously, the first and second functional regions having different refractive indices allows control and manipulation of the visual effect exhibited to a viewer of the security device without having to vary the geometry of the surface relief in different areas of the light control layer which is both difficult and time-consuming to do. The light incident upon the first and second functional regions impinges upon the colour shifting element at different angles of incidence due to different amounts of refraction as a result of the different refractive indices.

Typically, the first and second functional regions each comprise a surface relief. The surface relief of the first functional region may be different to the surface relief of the second functional region. In particularly advantageous embodiments, the first and second functional regions comprise substantially the same surface relief. For example, in some embodiments the light control layer may be in the form of a substantially uniform surface relief such that the first and second functional regions comprise substantially the same surface relief.

The expression "surface relief" is used to refer to a structure of elevations and depressions. This may be described as a non-planar part of the outwardly facing surface of light control layer. The surface relief typically has a plurality of facets angled with respect to the colour shifting element so as to define a plurality of elevations and depressions. Light incident upon the light control layer is refracted at the interface between the (typically) air and the angled facets of the surface relief so as to modify the angle of light subsequently incident upon the colour shifting element. The surface relief typically has a pitch (e.g. the distance between adjacent elevations) in the range of 1-100 μm, more preferably 5-70 μm, and structure depth (e.g. the height of an elevation) in the range of 1-100 μm, more preferably 5-40 μm. The light control layer is at least partially transparent, which may also include "translucent". The light control layer covers at least a part of the colour shifting element. In some examples the light control layer may cover substantially the entirety of the colour shifting element. The light control layer is typically colourless.

The expression "colour shifting element" is used to refer to any material which can selectively reflect or transmit incident light to create an optically variable effect, in particular an angularly dependent coloured reflection or transmission. It is envisaged that at least at one viewing angle, under illumination by visible light, the wavelength (or range of wavelengths) of light exhibited by the colour shifting element will be in the visible light range and therefore seen by the naked human eye as a visible colour. At at least one viewing angle, under illumination by visible light, the wavelength (or range of wavelengths) of light exhibited by the colour shifting element may be in the non-visible light range, for example the infra-red range of the electromagnetic spectrum. In such an instance the colour shifting element will appear black. In the context of the present specification, black is taken to be a colour. Under non-visible light illumination, the wavelength (or range of wavelengths) of light exhibited by the colour shifting element may be in the non-visible light range.

As a result, due to the difference in refractive index between the first and second functional regions of the light control layer, light incident upon the first and second functional regions at the same angle will impinge upon the colour shifting element at different angles, thereby generating light reflected from the colour shifting element having different wavelengths. Therefore, light corresponding to the first and second functional regions will exhibit different colours. By controlling the refractive index of the first and second functional regions, the exhibited colours may be controlled to provide a desired visual effect at at least one viewing angle.

Furthermore, upon changing viewing angle between first and second viewing positions (typically by "tilting" the device relative to a viewer), different colours may be exhibited by the same functional region, for example a red to green colour shift. Typically, the device is tilted relative to a viewer along a first tilt axis. The first tilt axis typically lies substantially in the plane of the security device. Alternatively or in addition, a viewer may change their position to change the viewing angle.

Examples of such a colour shifting element include photonic crystals, liquid crystals, interference pigments, pearlescent pigments, structured interference materials or thin film interference structures including Bragg stacks. A particularly suitable material for the colour shifting element is a liquid crystal film.

In general the colour shifting element may be substantially opaque or partially transparent (with various examples having been described above). A partially transparent colour shifting element (for example a liquid crystal film) transmits at least some of the light that is incident upon it as well as providing an optical effect in reflection. An example of a substantially opaque colour shifting element is an optically variable pigment. Optically variable pigments having a colour shift between two distinct colours, with the colour shift being dependent on the viewing angle, are well known. The production of these pigments, their use and their characteristic features are described in, inter-alia, U.S. Pat. Nos. 4,434,010, 5,059,245, 5,084,351, 5,135,812, 5,171,363, 5,571,624, EP-A-0341002, EP-A-0736073, EP-A-668329, EP-A-0741170 and EP-A-1114102.

Optically variable pigments having a viewing angle-dependent shift of colour are based on a stack of superposed thin-film layers with different optical characteristics. The hue, the amount of colour-shifting and the chromaticity of such thin-film structures depend inter alia on the material constituting the layers, the sequence and the number of layers, the layer thickness, as well as on the production process. Generally, optically variable pigments comprise an opaque totally reflecting layer, a dielectric layer with an index of refraction of 1.65 or less deposited on top of the opaque layer, and a semi-transparent partially reflecting layer applied on the dielectric layer.

The security device may be viewed in reflection or transmission. If the device is intended to be viewed in reflection and comprises a partially transparent colour shifting element such as a liquid crystal film, it is preferable that the security device further comprises an absorbing element comprising a light-absorbing material positioned on a distal side of the colour shifting element with respect to the light control layer (i.e. such that the colour shifting element is positioned between the light-absorbing material and the viewer) and operable to at least partially absorb light transmitted through the colour shifting element. Such a light-absorbing element positioned under the colour shifting element substantially absorbs light that is transmitted through the colour shifting element (and absorbs light originating from behind the colour shifting element with respect to the viewer), and therefore light reflected from the colour shifting element dominates. In the case where a substantially opaque colour shifting element is used, such an absorbing element is not required. In some embodiments, such an absorbing element may be provided in the form of indicia, such that, when viewed in reflected light, the colour shifting element is visible in the form of the indicia.

Throughout this specification, the term "light" refers to both visible light (see below) and non-visible light outside the visible spectrum, such as infra-red and ultraviolet radiation. "Visible light" refers to light having a wavelength within the visible spectrum, which is approximately 400 to 750 nm. It is most preferable that the visible light is white light, i.e. contains substantially all the visible wavelengths in more or less even proportion. The ultra-violet spectrum typically comprises wavelengths from about 200 nm to about 400 nm, and the infra-red spectrum typically comprises wavelengths from about 750 nm to 1 mm.

Throughout this specification, the term "colour" means a colour which can be seen by the naked human eye under the stated illumination conditions. This includes achromatic hues such as black, grey, white, silver etc., as well as chromatics such as red, blue, yellow, green, brown etc. "Substantially the same" colours are those which appear the same as one another in a cursory inspection (by the naked human eye) although they may not be an exact match under close examination. By the same logic, "different" colours are those which clearly present a contrast to one another that is visible to the naked human eye even without a close inspection. The difference might be in terms of the colour's hue or tone or both.

For example, in preferred embodiments, two colours will be considered substantially the same as one another if the Euclidean distance $\Delta E^*_{ab}$ between them in CIELAB colour space (i.e. the CIE 1976 L*a*b* colour space) is less than 3, more preferably less than 2.3. The value of $\Delta E^*_{ab}$ is measured using the formula $$\Delta E^*_{ab}=\sqrt{(\Delta L^*)^2+(\Delta a^*)^2+(\Delta b^*)^2}$$

Where ΔL*, Δa* and Δb* are the distance between the two colours along the L*, a* and b* axes respectively (see "Digital Color Imaging Handbook" (1.7.2 ed.) by G. Sharma (2003), CRC Press, ISBN 0-8493-0900-X, pages 30 to 32). Conversely, if $\Delta E^*_{ab}$ is greater than or equal to 3 (or, in more preferred embodiments, greater than or equal to 2.3), the two colours will be considered different. The colour difference $\Delta E^*_{ab}$ can be measured using any commercial spectrophotometer, such as those available from Hunterlab of Reston, Va., USA.

Typically, at least at one viewing angle, the first and second functional regions exhibit different colours.

Typically, the surface relief of the light control layer is further adapted to modify the angle of light from the colour shifting element. In the same manner that light incident upon the security device is refracted at the interface between the air and the light control layer, fight from the colour shifting element is also refracted at the interface between the light control layer and the air. As a result, the presence of the light control layer having the surface relief means that a different colour is exhibited to an observer viewing the security device at a first viewing angle than would be exhibited to an observer viewing the colour shifting element in isolation at that viewing angle.

Typically, the first functional region has a refractive index in the range of 1.2 to 1.8, preferably in the range of 1.35-1.7.

Similarly, the second functional region has a refractive index in the range of 1.2 to 1.8, preferably in the range of 1.35-1.7. As discussed above, the first functional region has a different refractive index to the second functional region. The difference in refractive index between the first and second functional regions is typically at least 0.1, preferably at least 0.2 and even more preferably at least 0.3.

In preferred embodiments, at least one of the first and second functional regions defines indicia. This provides a particularly striking effect due to the fact that at least at one viewing angle, the first and second functional regions exhibit different colours, such that the indicia will appear coloured against a different colour background. Furthermore, upon tilting the device relative to the viewer, these colours may change due to the characteristics of the colour shifting element. Typically such indicia comprises at least a digit, letter, geometric shape, symbol, image, graphic or alphanumerical text. A particularly striking effect is exhibited if, at one viewing angle (typically a normal viewing angle with respect to the security device), both the first and second functional regions exhibit substantially the same colour such that they are not distinguishable. On tilting the device, the first and second regions exhibit different colours, thus providing a "hidden image" effect. Both the first and second functional regions may exhibit substantially the same colour at a viewing angle even though light incident upon the light control layer subsequently impinges upon the colour shifting element at different angles, due to the fact that a range of wavelengths of light reflected by the colour shifting element may be perceived by the naked eye as the same colour. On tilting the device, the difference in angles of incidence (and therefore the wavelengths of reflected light) on the colour shifting element may increase such that the different colours are exhibited.

In some embodiments the first and second functional regions substantially abut each other. In other words there is no gap between the first and second functional regions. In alternative embodiments, the first and second functional regions may be spaced apart. In such embodiments the first and second functional regions are typically laterally spaced apart. In yet further embodiments the light control layer may comprise three or more functional regions, with some functional regions substantially abutting one another and some being spaced apart. In the cases where the functional regions are spaced apart, the region between the functional regions may be described as a "non-functional" region of the light control layer in that is does not substantially modify the angle of light to or from the colour shifting element. Such a non-functional region does not comprise a surface relief. The non-functional region may therefore comprise a substantially planar portion substantially parallel with the colour shifting element (i.e. does not comprise a surface relief), or may comprise no light control layer material, such that the colour shifting element is exposed between the first and second regions. In this second case the spaced apart first and second functional regions are still part of the same light control layer. The use of first and second functional regions spaced apart by a non-functional region provides the ability to exhibit further coloured effects.

The material of the light control layer may be provided by at least one of intaglio printing, gravure, flexo printing, inkjet printing, knife coating, curtain or blade techniques. Typically, the light control layer comprises a polymer. The surface relief of the light control layer may be formed in a single step, for example by an embossing, extrusion or cast curing process. This process typically occurs after the provision of the light control material. For example, it is envisaged that a layer of polymer comprising regions of different refractive index will be applied to a colour shifting element, and an embossing die will subsequently be provided having a surface structure corresponding to the desired light control layer. As discussed, a particular advantage of the present invention is being able to control the optical effect exhibited to a viewer through the use of varying refractive index of the light control layer rather than changing the geometry of the light control layer in particular regions. Therefore, the same embossing die may be used to manufacture a plurality of different security devices that exhibit different optical effects.

The light control layer typically comprises a UV curable material. Suitable UV curable materials may comprise a polymeric material which may typically be of one of two types of polymeric resin, namely:

a) Free radical cure resins, which are typically unsaturated resins or monomers, pre-polymers, oligomers etc. containing vinyl or acrylate unsaturation for example and which cross-link through use of a photo initiator activated by the radiation source employed e.g. UV.

b) Cationic cure resins, in which ring opening (e.g. epoxy types) is effected using photo initiators or catalysts which generate ionic entities under the radiation source employed e.g. UV. The ring opening is followed by intermolecular cross-linking.

The radiation used to effect curing is typically UV radiation but could comprise electron beam, visible, or even infra-red or higher wavelength radiation, depending upon the material, its absorbance and the process used. Examples of suitable curable materials include UV curable acrylic based clear embossing lacquers or those based on other compounds such as nitro-cellulose.

The curable material could be elastomeric and therefore of increased flexibility. An example of a suitable elastomeric curable material is aliphatic urethane acrylate (with suitable cross-linking additive such as polyaziridine).

Examples of UV-curable monomers that may be used to form a polymeric light control layer include 1-Ethoxylated phenol acrylate, 2-Ethoxylated phenol acrylate, Bisphenol A ethoxylated acrylate, Phenoxy benzyl acrylate, 1-Ethoxylated-o-phenylphenol acrylate and Benzyl acrylate, Bisphenol fluorine diacrylate and Modified bisphenol fluorine diacrylate.

Examples of UV-curable oligomers that may be used to form a polymeric light control layer include halogen oligomers such as Bromo epoxy acrylate, and non-halogen oligomers such as Epoxy acrylate and Urethane acrylate.

In some embodiments, a polymeric light control layer may comprise at least one monomer and at least one oligomer.

Examples of UV-curable polymers that may be used to form the light control layer include Poly(pentabromophenyl methacrylate), Poly(pentabromophenyl acrylate), Poly (pentabromobenzyl methacrylate), Poly(pentabromobenzyl acrylate), Poly(2,4,6-tribromophenyl methacrylate), Poly (vinylphenylsulfide), Poly(1-napthyl methacrylate), Poly(2-vinylthiophene), Poly(2,6-dichlorostyrene), Poly(N-vinylphthalimide), Poly(2-chlorostyrene), Poly (pentachlorophenyl methacrylate), Poly(1,1,1,3,3,3-hexafluoroisopropyl acrylate), Poly(2,2,3,3,4,4,4-heptafluorobutyl acrylate), Poly(2,2,3,3,4,4,4-heptafluorobutyl methacrylate), Poly(2,2,3,3,3-pentafluoropropyl acrylate), Poly(1,1,1,3,3,3-hexafluoroisopropyl methacrylate), Poly(2,2,3,4,4,4-hexafluorobutyl acrylate), Poly(2,2,3,4,4,4-hexafluorobutyl methacrylate), Poly(2,2,3,3,3-pentafluoropropyl methacrylate), Poly(2,2,2-trifluoroethyl acrylate), Poly(2,2,3,3-tetrafluoropropyl acrylate), Poly(2,2,3,3-tetrafluoropropyl methacrylate) and Poly(2,2,2-trifluoroethyl methacrylate).

Typically, the surface relief of the light control layer comprises at least one microstructure. In preferred embodiments, the microstructure is a linear microprism and the surface relief comprises an array of linear microprisms. However, a number of different surface reliefs of the light control layer are envisaged. For example, the surface relief may comprise two or more arrays of linear microprisms, wherein the long axes of one array are angularly offset from the axes of the other array. Such a surface relief would provide a rotational optical effect as well as the colour shifting effect dependent on a tilt angle of the security device, wherein the rotational effect is dependent on the azimuthal angle of viewing with respect to the arrays of linear micro prisms. The optical effect due to the presence of a microprism array will be more readily observed when the device is viewed in an azimuthal direction perpendicular to the long axes of the array rather than in an azimuthal direction parallel to the long axes of the array.

Other forms of microprismatic structures are envisaged, for example structures comprising microprisms having an asymmetrical structure or a repeating faceted structure.

The microstructure may be a one dimensional microstructure. By "one dimensional" it is meant that the optical effect provided by the microstructure is primarily observed in one rotational viewing direction with respect to an individual microstructure, typically perpendicular to a long axis of the microstructure. However, a surface relief comprising a two dimensional microstructure is also envisaged wherein the optical effect due to the presence of the microstructure is readily observed at two or more rotational viewing directions. Examples of such a two-dimensional microstructure include corner cubes and pyramidal structures. The surface relief may alternatively comprise a lenticular array having a curved surface structure.

In accordance with a second aspect of the present invention there is provided a security article comprising a security device according to the first aspect, wherein the security article is preferably a security thread, strip, patch, label, transfer foil or a polymer substrate. The polymer substrate may be a data page for a passport, for example.

In accordance with a third aspect of the present invention there is provided a security document comprising a security device according to the first aspect, or a security article according to the second aspect. The security device or security article may be located in a transparent window region of the document, or inserted as a window thread, or affixed to a surface of the document. Such a security document preferably comprises a banknote, identity document, passport, cheque, visa, licence, certificate or stamp. Where the security article is a polymer substrate, the polymer substrate is typically a laminate for a data page of security document such as a passport or identification card. Another scenario is that the polymer substrate could be the substrate of a polymer banknote i.e. the security device is formed directly on the polymer banknote substrate.

In accordance with a fourth aspect of the present invention there is provided a method of manufacturing a security device, the method comprising: providing an at least partially transparent light control layer so as to cover at least a part of a colour shifting element that exhibits different colours dependent on the angle of incidence of light impinging upon it, wherein; the light control layer comprises a surface relief adapted to modify the angle of light incident upon the light control layer, and further wherein; the light control layer comprises at least first and second functional regions having different refractive indices such that light incident upon the first functional region impinges upon the colour shifting element at a first angle of incidence, and light incident upon the second functional region impinges upon the colour shifting element at a second, different, angle of incidence.

As in the first aspect, the expression "colour shifting element" is used to refer to any material which can selectively reflect or transmit incident light to create an optically variable effect, in particular an angularly dependent coloured reflection or transmission. It is envisaged that at least at one viewing angle, under illumination by visible light, the wavelength (or range of wavelengths) of light exhibited by the colour shifting element will be in the visible light range and therefore seen by the naked human eye as a visible colour. At at least one viewing angle, under illumination by visible light, the wavelength (or range of wavelengths) of light exhibited by the colour shifting element may be in the non-visible light range, for example the infra-red range of the electromagnetic spectrum. In such an instance the colour shifting element will appear black. Under non-visible light illumination, the wavelength (or range of wavelengths) of light exhibited by the colour shifting element may be in the non-visible light range.

Typically, the material of the light control layer is provided by at least one of intaglio printing, gravure, flexo printing, inkjet printing, knife coating, curtain or blade techniques. The material may be any of the materials set out above in the first aspect of the invention for example.

The surface relief of the light control layer may be formed by one of embossing, extrusion or cast curing, typically subsequently to the provision of the light control layer material to a colour shifting element.

In some embodiments the surface relief is provided by cast curing, and the first and second functional regions are cured substantially simultaneously. In other embodiments the surface relief is provided by cast curing, and the first functional region and second functional region are cured at different times.

In accordance with a fifth aspect of the invention there is provided a method of forming a security article comprising the method of forming a security device according to the fourth aspect, wherein the security article is preferably a security thread, strip, patch, label, transfer foil or a polymer substrate.

In accordance with a sixth aspect of the invention there is provided a method of forming a security document comprising the method of forming a security device according to the fourth aspect, or the method of forming a security article according to the fifth aspect, wherein the security device or security article is preferably located in a transparent window region of the document, or is inserted as a window thread, or is affixed to a surface of the document. Such a security document preferably comprises a banknote, identity document, passport, cheque, visa, licence, certificate or stamp.

BRIEF DESCRIPTION OF THE DRAWINGS

Examples of the invention will now be described with reference to the attached drawings, in which.

DETAILED DESCRIPTION OF THE DRAWINGS

Figure 1A:
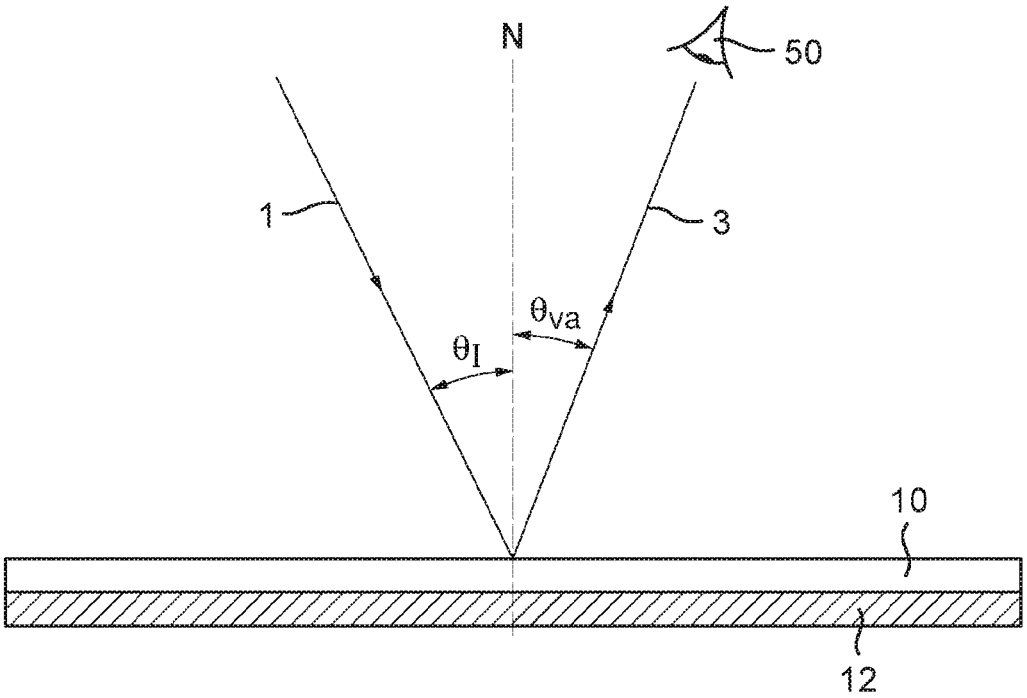
FIGS. 1*a* and 1*b* schematically outline the principles of the invention.
Figure 1B:
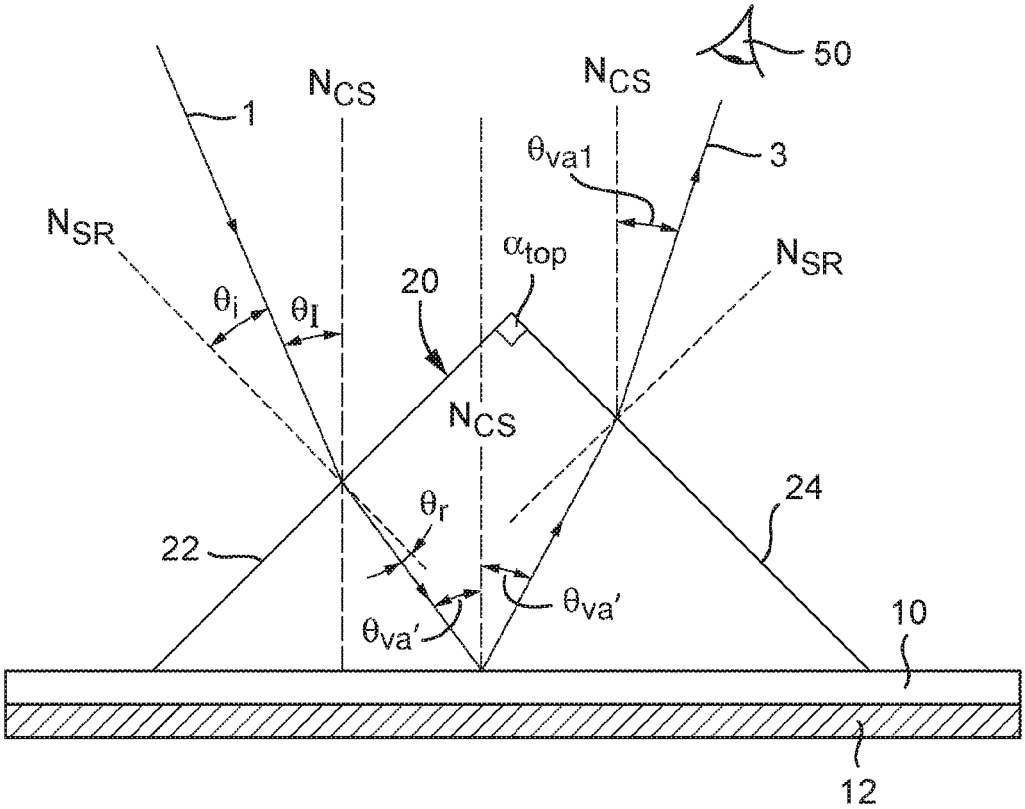

FIGS. 1*a* and 1*b* outline the general concept of the invention. FIG. 1*a* is a light ray diagram schematically illustrating the effect of light incident upon a colour shifting element 10. In this example the colour shifting element 10 is partially transparent liquid crystal layer and an absorbing element 12 is placed on a distal side of the colour shifting element with respect to a viewer 50. At a viewing angle $\Theta_{va}$ with respect to the normal, N, of the colour shifting element, an observer sees light 3 reflected from the colour shifting element that had an angle of incidence $\Theta_I$ on the colour shifting element equal to $\Theta_{va}$. (see light ray 1).

As is understood in the art, when light is incident upon the colour shifting element 10, some of the light is reflected and undergoes Bragg reflection. The wavelength (and hence the colour exhibited to the viewer 50) of the reflected light is dependent on the structure and composition of the colour shifting element. In this particular example, as the colour shifting element is partially transparent, the absorbing element is used to substantially absorb the light transmitted through the colour shifting element in order to enhance the optical effect exhibited to the viewer when viewing the colour shifting element in reflection.

As the viewing angle $\Theta_{va}$ increases (and therefore the angle of incidence $\Theta_I$ of the incident light increases), the wavelength of the reflected light generally decreases due to a change in path length such that a colour change is exhibited to the viewer on a change of viewing angle (e.g. "tilting" the colour shifting element). Typically this may be a red to green colour shift or an infra-red (i.e. the colour shifting element exhibits a black colour) to red colour shift.

FIG. 1*b* schematically illustrates the effect of providing a surface relief 20 over the colour shifting element 10 such that it is positioned between the colour shifting element and the observer 50. Here the surface relief is in the form of a linear microprism having its long axis extending into the plane of the page and having a symmetrical triangular cross section. The "top angle" of the prism $\alpha_{top}$ in this instance is 90°. The surface relief is formed of an at least partially transparent polymer having a refractive index of $n_1$. The normal to the colour shifting element is shown at $N_{cs}$ and the normal to a facet of the surface relief is shown as $N_{sr}$.

For the following discussion, we will consider the combination of the colour shifting element and surface relief as a security device 100, with a viewing angle $\Theta_{va1}$ of the device being defined with respect to the normal of the colour shifting element, as in the example of FIG. 1*a*.

At a viewing angle $\Theta_{va1}$, light is incident upon the device at an angle of incidence $\Theta_I$, as shown by light ray 1. When light ray 1 is incident upon facet 22 of the surface relief, it is refracted due to the difference in refractive index between the medium in which incident ray 1 travels (typically air with a refractive index $n_{air}$~1) and the material of the surface relief. In the present example, and using the notation seen in FIG. 1*b*, Snell's Law gives us:

$$n_{air} \sin \Theta_i = n_1 \sin \Theta_r, \quad (1)$$

where $\Theta_i$ and $\Theta_r$ are the angles of incidence and refraction, respectively, of the incident light ray 1 with respect to the normal $N_{sr}$.

We can now see that the refracted light ray is incident on the colour shifting element 10 with larger angle of incidence $\Theta_{va'}$ (with respect to the normal $N_{cs}$) than the angle of incidence $\Theta_I$ if the surface relief were not present. As a result, the wavelength of light reflected from the colour shifting element 10 (shown at light ray 3) is different (i.e. exhibits a different colour) as compared to if the surface relief were not present. The reflected light ray 3 is refracted at facet 24 and observed by viewer at viewing angle $\Theta_{va1}$.

In the example shown in FIG. 1*b*, the surface relief 20 has a symmetrical cross-section and therefore $\Theta_I = \Theta_{va1}$. However, for non-symmetrical cross-sections, $\Theta_I$ and $\Theta_{va1}$ will be different. In general through $\Theta_{va'}$ will differ from $\Theta_I$ due to refraction, and the refractive index of the light control layer is used to control this in order to exhibit the desired effect to the viewer 50. The effect of different wavelengths of light refracting by different amounts is negligible and will not be perceived by a viewer.

As it is the angle of incidence of a light ray on the colour shifting element that determines the wavelength, and therefore the perceived colour, of light exhibited to a viewer of the device 100, we can see that the presence of the surface relief positioned between the colour shifting element and the viewer enables the control of the colour exhibited by the device.

Moreover, we can see that $\Theta_r$ (and therefore $\Theta_{va'}$) is dependent upon the refractive index of the surface relief material. The inventors have advantageously realised that they can control the optical effect exhibited to a viewer of such a device by varying the refractive index of the surface relief material. This is particularly advantageous as the surface relief itself may be uniform across the device, with only the refractive index of the surface relief material varying.

Table 1 below shows the effect that different refractive indices of the surface relief material have on the angle of incidence $\Theta_{va'}$ upon the colour shifting element in comparison with the angle of incidence of light upon the device, $\Theta_I$. The numerical figures in Table 1 are for a symmetrical triangular linear prism with a top angle $\alpha_{top}$ of 90°, as described above in FIG. 1*b*.

Similarly, Table 2 shows the effect that different refractive indices of the surface relief material have on the angle of incidence Θva' upon the colour shifting element for a symmetrical triangular prism with a top angle atop of 60°.

TABLE 1

| Effect of different refractive indices for αtop = 90° | | |
|---|---|---|
| θI (°) | Refractive index of surface relief material | Angle of incidence at colour shifting element, θva' (°) |
| 15 | 1.2 | 20.38 |
| | 1.25 | 21.42 |
| | 1.3 | 22.38 |
| | 1.35 | 23.26 |
| | 1.4 | 24.08 |
| | 1.45 | 24.83 |
| | 1.5 | 25.53 |
| | 1.55 | 26.18 |
| | 1.6 | 26.67 |
| | 1.65 | 27.36 |
| | 1.7 | 27.90 |
| 10 | 1.2 | 16.45 |
| | 1.25 | 17.69 |
| | 1.3 | 18.82 |
| | 1.35 | 19.86 |
| | 1.4 | 20.81 |
| | 1.45 | 21.70 |
| | 1.5 | 22.52 |
| | 1.55 | 23.28 |
| | 1.6 | 23.99 |
| | 1.65 | 24.66 |
| | 1.7 | 25.28 |
| 5 | 1.2 | 12.61 |
| | 1.25 | 14.05 |
| | 1.3 | 15.37 |
| | 1.35 | 16.57 |
| | 1.4 | 17.67 |
| | 1.45 | 18.69 |
| | 1.5 | 19.63 |
| | 1.55 | 20.50 |
| | 1.6 | 21.31 |
| | 1.65 | 22.07 |
| | 1.7 | 22.78 |

TABLE 2

| Effect of different refractive indices for αtop = 60° | | |
|---|---|---|
| θI (°) | Refractive index of surface relief material | Angle of incidence at colour shifting element, θva' (°) |
| 15 | 1.2 | 23.90 |
| | 1.25 | 25.55 |
| | 1.3 | 27.05 |
| | 1.35 | 28.41 |
| | 1.4 | 29.66 |
| | 1.45 | 30.81 |
| | 1.5 | 31.87 |
| | 1.55 | 32.86 |
| | 1.6 | 33.77 |
| | 1.65 | 34.62 |
| | 1.7 | 35.42 |
| 10 | 1.2 | 20.33 |
| | 1.25 | 22.21 |
| | 1.3 | 23.90 |
| | 1.35 | 25.43 |
| | 1.4 | 26.83 |
| | 1.45 | 28.11 |
| | 1.5 | 29.29 |
| | 1.55 | 30.38 |
| | 1.6 | 31.39 |
| | 1.65 | 32.34 |
| | 1.7 | 33.22 |
| 5 | 1.2 | 16.95 |
| | 1.25 | 19.06 |
| | 1.3 | 20.94 |
| | 1.35 | 22.64 |
| | 1.4 | 24.19 |
| | 1.45 | 25.60 |

TABLE 2-continued

| Effect of different refractive indices for αtop = 60° | | |
|---|---|---|
| θI (°) | Refractive index of surface relief material | Angle of incidence at colour shifting element, θva' (°) |
| | 1.5 | 26.90 |
| | 1.55 | 28.10 |
| | 1.6 | 29.20 |
| | 1.65 | 30.23 |
| | 1.7 | 31.19 |

As can be seen from Tables 1 and 2, for a given angle of incidence upon the device $\Theta_I$, as the refractive index of the surface relief material increases, so does the angle of incidence of the light incident upon the colour shifting element. In general, as the angle of incidence upon the colour shifting element increases, the wavelength of light reflected from the colour shifting element decreases (i.e. red to blue). Therefore, the colour exhibited to a viewer of a device changes with refractive index. This can be used to allow a device to exhibit regions of different colour at a given viewing angle, while the device still maintains its colour shifting properties upon tilting. Examples of this will now be explained below.

Figure 2A:
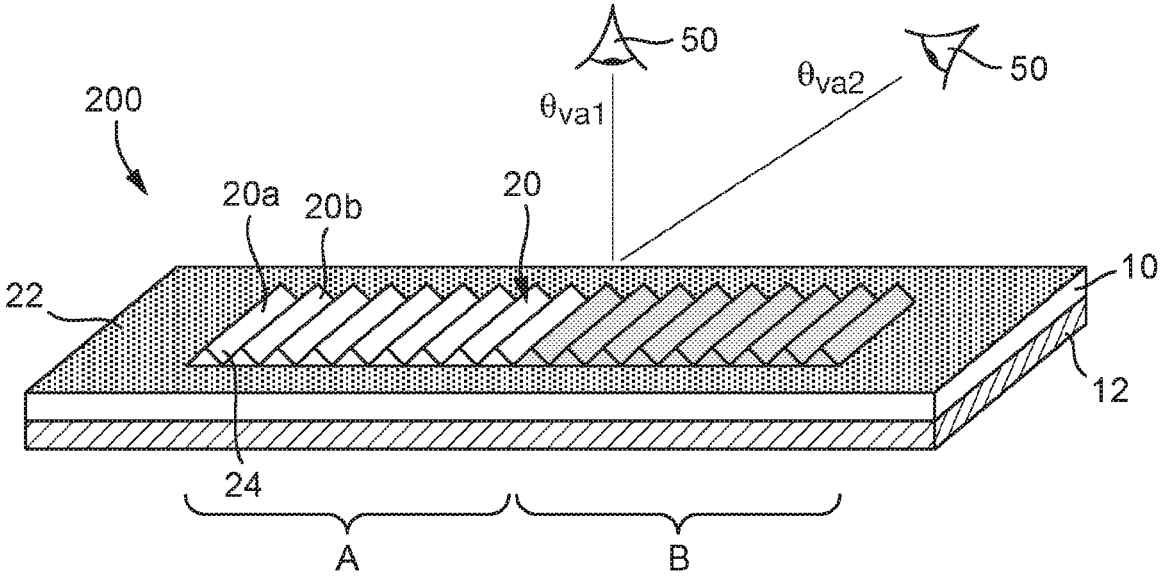
FIG. 2*a* is a perspective view of a security device according to a first embodiment.

FIG. 2*a* is a perspective view of a security device 200 according to a first embodiment. The device 200 comprises a colour shifting element 10 partially covered by a light control layer 20. The colour shifting element 10 in this case is a liquid crystal element exhibiting a black (i.e. light in the IR part of the EM spectrum) to red colour shift upon tilting away from normal viewing. Here, the term "tilting" is used to refer to a change in viewing angle from $\Theta_{va1}$ to $\Theta_{va2}$. The liquid crystal is partially transparent and, as the device 200 is intended to be viewed in reflection, an absorbing element 12 is positioned beneath the liquid crystal in order to absorb light transmitted through the liquid crystal.

The light control layer 20 comprises a microprismatic structure comprising an array of linear microprisms that define a surface relief, as described above with reference to FIG. 1*b*. The microprisms substantially abut each other along their long axes. The microprisms are symmetrical triangular microprisms having equal length facets 22, 24, with each microprism having the same top angle $\alpha_{top}$ and therefore the same geometry. Individual microprisms 20*a* and 20*b* are labelled in FIG. 2*a*.

As can be seen in FIG. 2*a*, the array of microprisms has two functional regions, labelled as A and B. The microprisms of region A all have the same refractive index $n_1$, and the microprisms of region B all have the same refractive index $n_2$, where $n_1$ and $n_2$ are different. In this example embodiment $n_2$ is greater than $n_1$ but it will be appreciated that $n_2$ may be smaller than $n_1$. The microprisms are each substantially colourless, with the different "tints" in FIG. 2*a* schematically representing the different refractive indices of the functional regions.

The visual effect of device 200 will be explained with reference to two viewing angles $\Theta_{va1}$ and $\Theta_{va2}$, shown in FIG. 2*a*. Viewing angle $\Theta_{va1}$ is a substantially normal angle of viewing, and viewing angle $\Theta_{va2}$ is an off-normal angle of viewing (or equivalent to tilting the device 200 with the viewer remaining stationary). The contribution of the light control layer to the overall visual effect is most pronounced when viewed along a direction perpendicular to the long axes of the microprisms, and with the tilt axis being parallel with the long axes of the microprisms.

Figure 2B:
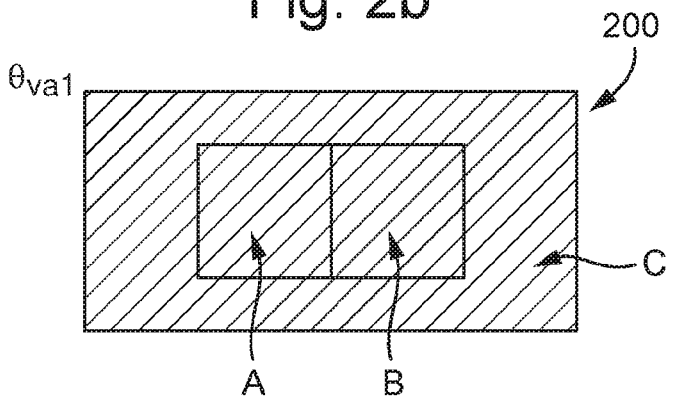
FIG. 2*b* is a plan view of the security device of the first embodiment when viewed from a first angle.

The visual effect exhibited to a viewer by the device 200 at viewing angle $\Theta_{va1}$ is schematically illustrated in FIG. 2*b*, which shows the device 200 in plan view. FIG. 2*b* shows the functional regions A and B, together with region C which comprises the area of colour shifting element that is not covered by the light control layer. At a substantially normal angle of viewing $\Theta_{va1}$, the light reflected from the colour shifting element is in the infra-red region of the electromagnetic spectrum, and therefore region C exhibits a black colour to the viewer.

Furthermore, although the surface relief of the light control layer will refract the incident light for normal viewing such that the light is incident on the colour shifting element 10 at an angle of incidence ⊖va' that is not 0°, typically this incident angle ⊖va' will be small (of the order of <5°) such that the reflected light from the colour shifting element will still be in the infra-red range of the electromagnetic spectrum. Therefore, at a normal angle of viewing $\Theta_{va1}$, both functional regions A and B, and region C, will exhibit a black colour to a viewer. The device 200 will therefore appear a substantially uniform black colour with substantially imperceptible colour differences between functional regions, as schematically illustrated by the uniform shading across regions A, B and C in FIG. 2*b*.

Figure 2C:
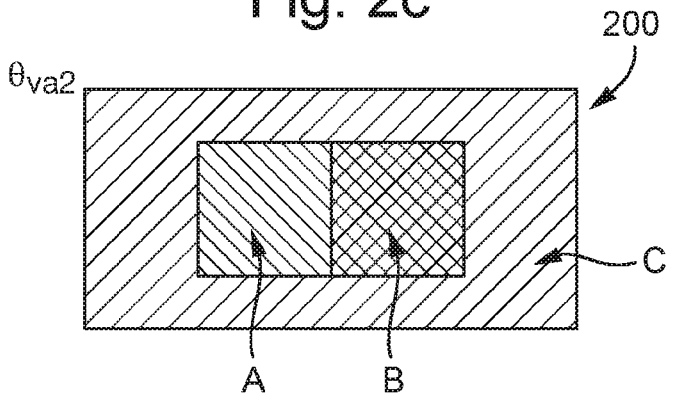
FIG. 2*c* is a plan view of the security device of the first embodiment when viewed from a second angle.

Upon tilting the device 200 and viewing the device at viewing angle $\Theta_{va2}$, region C will exhibit a red colour due to the colour shifting properties of the colour shifting element. Furthermore, due to the refraction of light incident upon the light control layer as described above in FIG. 1*b*, light incident upon functional region A for viewing angle $\Theta_{va2}$ will impinge on colour shifting element 10 with an angle of incidence $\Theta_{va'}$ that is greater than that for light incident upon the colour shifting element for region C. As a result, the wavelength of light from functional region A at viewing angle $\Theta_{va2}$ will be smaller than that from region C. Similarly, due to the fact that the refractive index of functional region B ($n_2$) is greater than that of region A ($n_1$), the wavelength of light from functional region B at viewing angle $\Theta v_{a2}$ will be smaller than both that from both functional region A and region C. Therefore, at viewing angle $\Theta_{va2}$, each region will exhibit a different colour to a viewer—for example region C may exhibit red, functional region A green and functional region B blue. These different colours are schematically illustrated by the different shadings in FIG. 2*c*. It is to be noted that particular shadings in the plan views throughout this specification do not represent particular colours, and that the different shadings in the plan view figures are used to highlight colour differences.

This change in appearance of the uniform black colour to the three regions of different colour upon changing the viewing angle provides a striking visual effect to the viewer that is easy to authenticate, and yet difficult to replicate. It is particularly advantageous that the different optical effects can be provided by the different functional regions of the light control layer without having to vary the facet angles. A particularly interesting effect would be seen if one of the regions defined indicia (such as a digit, letter, geometric shape, symbol, image, graphic or alphanumerical text). Such indicia would not be distinguishable at a normal angle of viewing, and would only be revealed upon tilting the device.

It is worth noting that the use of a light control layer may also allow for a wider range of colours to be exhibited upon tiling the device as compared to a colour shifting element in isolation. This is because light that may have been totally internally reflected at the boundary between the colour shifting element and air may now travel through the light control layer due to the smaller change in refractive index at the colour shifting element boundary.

Figure 3:
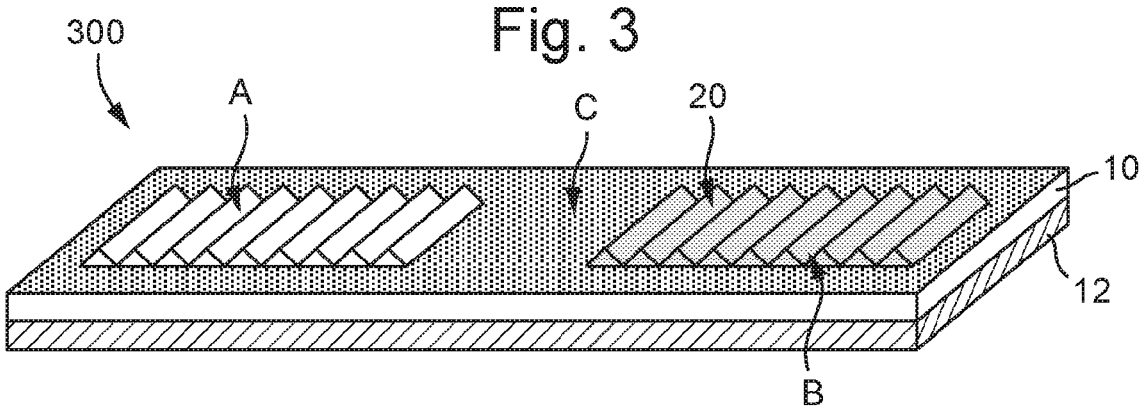
FIG. 3 is a perspective view of a security device according to another embodiment.

In FIG. 2*a*, the functional regions A and B of the light control layer are shown as abutting one another. This does not necessarily need to be the case however, and FIG. 3 shows a similar device 300 having a light control layer 20 comprising microprismatic functional regions A and B that are spaced apart. In this case the functional regions are spaced apart in a direction perpendicular to the long axes of the microprisms, although it will be appreciated that functional regions may alternatively or in addition be spaced apart in a direction parallel to the long axes of the microprisms. Here, both functional regions A and B, although laterally spaced apart, are considered as part of the same light control layer 20. The microprisms are each substantially colourless, with the different "tints" in FIG. 3 schematically representing the different refractive indices of the functional regions.

Figure 4A:
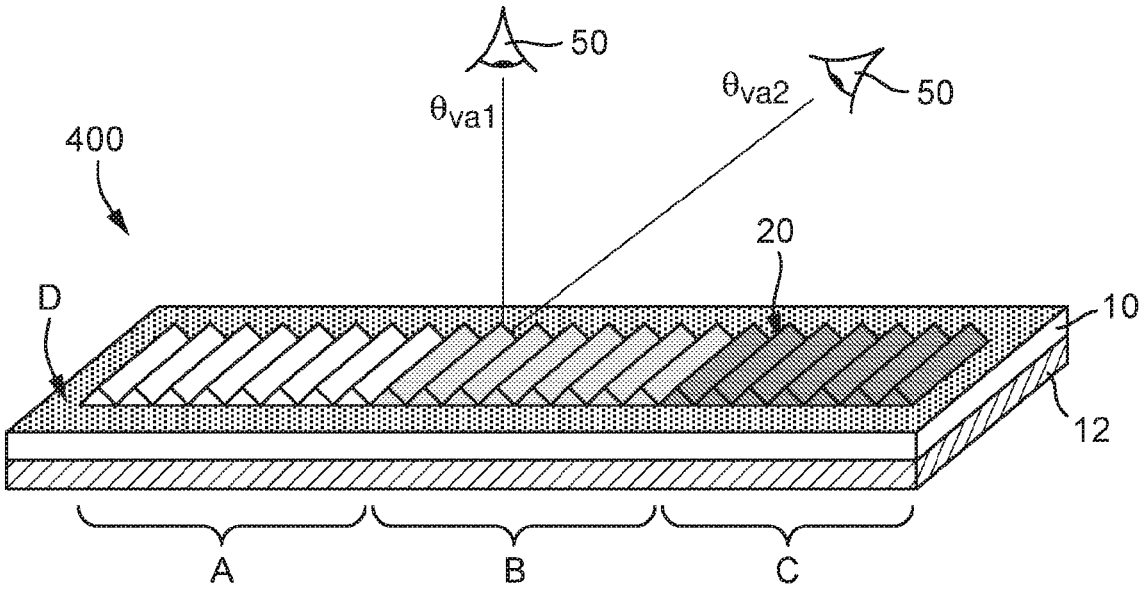
FIG. 4*a* is a perspective view of a security device according to another embodiment of the invention.

FIG. 4*a* is a perspective view of a security device 400 according to a further embodiment of the invention. In the same manner as device 200 described above, device 400 comprises a colour shifting element 10, an absorbing element 12 and a light control layer 20 comprising a plurality of symmetrical triangular microprisms. However, whereas the light control layer 20 of device 200 comprised two functional regions A and B having different refractive indices, the light control layer 20 of device 400 comprises three functional regions A, B and C. Each individual microprism within a functional region has substantially the same refractive index, but the microprisms of different functional regions have differing refractive indices. In this case for example, the refractive index for the microprisms of functional region A is greater than that for functional region B, and the refractive index for the microprisms of functional region B is greater than that for functional region C. However, other variations in refractive index may be used. The microprisms are each substantially colourless, with the different "tints" in FIG. 4*a* schematically representing the different refractive indices of the functional regions.

Figure 4B:
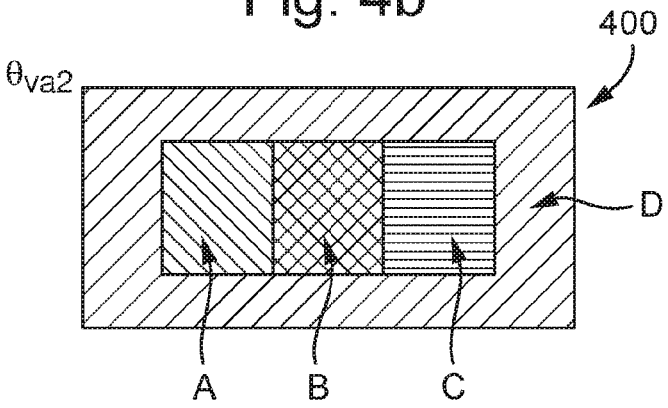
FIG. 4*b* is a plan view of said embodiment when viewed at one viewing angle.

At a normal viewing angle $\Theta_{va1}$ (seen in FIG. 4*a*), none of the functional regions A, B and C are discernible to the naked eye and the device appears a uniform black colour for the same reasoning as described above with respect to FIG. 2*a*. However, upon viewing at an off-normal angle $\Theta_{va2}$, the device 400 exhibits four different colours, as schematically illustrated in the plan view shown in FIG. 4*b*. Each functional region A, B and C of the light control layer exhibits a different colour due to their differing refractive indices, and the colour shifting element that is not covered by light control layer (labelled as region D) exhibits a further different colour.

Although the light control layer 20 of device 400 is described as having three functional regions of differing refractive index, it will be appreciated that two of the regions may have the same refractive index (e.g. regions A and C). Furthermore, light control layers having four or more functional regions are envisaged.

Figure 5:
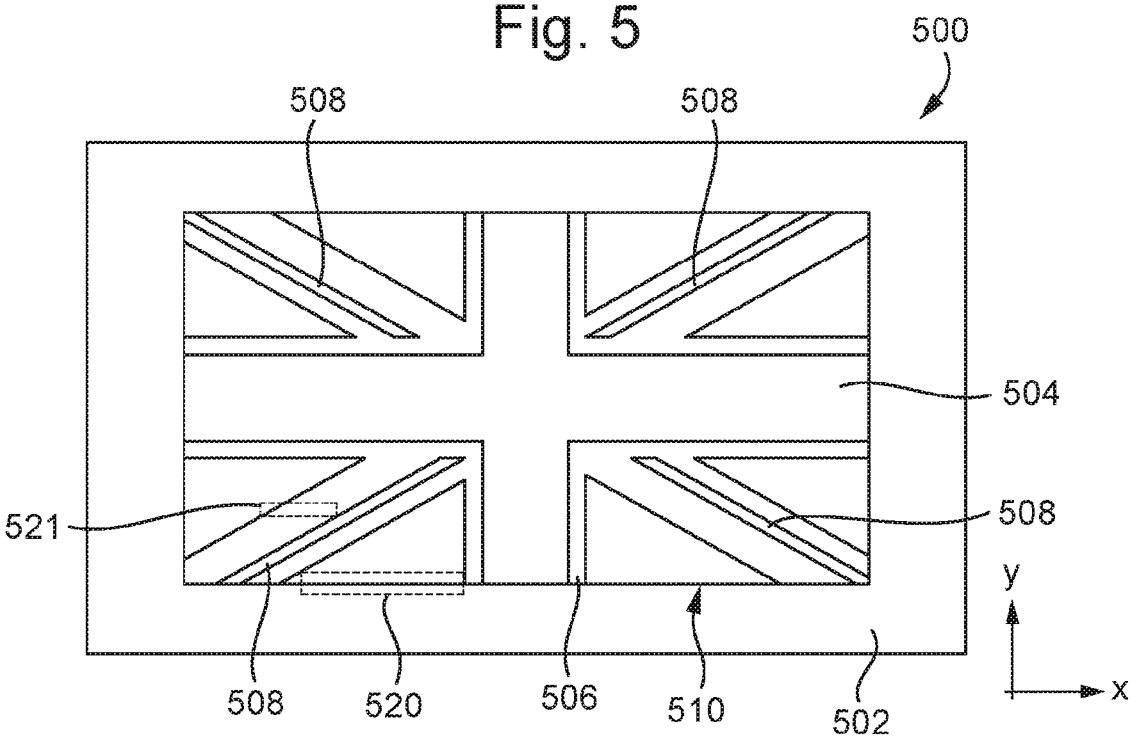
FIG. 5 is a plan view of a security device according to a further embodiment of the invention, when viewed from one viewing angle.

FIG. 5 is a plan view of a security device 500 according to an embodiment of the invention, which illustrates how varying the refractive index of the light control layer may be used to define indicia at at least one angle of view. In the example, the indicia is a union flag. The security device 500 comprises a colour shifting element 502, an area of which is covered by a light control layer 510 which comprises a plurality of linear triangular microprisms as have been discussed above. In this case, the long axes of the microprisms are orientated so as to be parallel with the long axis of the security device 500 (i.e. along the x axis), such that the colour shifting effect is most pronounced when tilting the device about the x axis.

In this case the colour shifting element 502 comprises a partially transparent liquid crystal layer exhibiting a black (i.e. the reflected light is in the infra-red part of the EM spectrum) to red colour shift on tilting away from normal viewing. As the device is intended to be viewed in reflection an absorbing element (not shown) is used such that the reflected light dominates the visual impression given to a user.

The light control layer 510 is divided into a plurality of regions 504, 506, 508 which generally define the flag indicia, as shown in FIG. 5, and the microprisms of different regions have different refractive indices such that, at least at one viewing angle, the different regions will exhibit different colours. Each microprism of the light control layer is orientated in the same direction and has the same facet angles with respect to the plane of the colour shifting element. However, the length of the long axes of the microprisms may vary according to its position within the light control layer 510, as schematically shown by the example microprism plan view outlines 520 and 521.

At a normal angle of viewing, the security device 500 appears a uniform black colour, in the same manner as has been explained above with reference to FIGS. 2 and 4. However, upon tilting about a tilt axis substantially parallel to the x axis, at at least one viewing angle, each of the regions 504, 506 and 508 will exhibit different colours against a red background (from the colour shifting element not covered by the light control layer), thereby defining the flag. This striking change in appearance on tilting the device ensures ease of authenticity and yet difficulty in counterfeiting.

Although FIG. 5 illustrates a specific flag indicia, the skilled person will understand that the light control layer can be arranged in a wide variety of different ways in order to obtain a desired indicia and visual effect.

In order to manufacture a security device according to the invention, the absorbing element (if required) and colour shifting element are first laid down on a suitable polymeric carrier substrate, such as a PET or BOPP foil. Here, all printing methods that are suitable for application of the various layers may be used, such as intaglio printing, gravure, flexo printing, inkjet printing, knife coating, curtain or blade techniques. Subsequently the light control layer is formed, as will be described below with reference to FIGS. 6, 7 and 8.

For ease of description, we will first consider the manufacture of device 200 (illustrated in FIG. 2*a*), although the skilled person will understand how to manufacture devices having a different light control layer arrangement. Firstly, the absorbing element and colour shifting element are provided on a suitable polymeric carrier substrate to form device substrate 200*a*. In one embodiment, shown in FIG. 6, a first radiation-curable material (corresponding to functional region A of the device) is applied to the outer surface of a substantially cylindrical casting cylinder 3100 by first applicator 3310. The outer surface of the casting cylinder carries the inverse surface relief of the desired surface relief of the light control layer. Excess material may be removed by doctor blade 3350. A second radiation-curable material (corresponding to functional region B) having a different refractive index to the radiation-curable material corresponding to region A is applied to the outer surface of the casting cylinder by second applicator 3320, and again any excess may be removed by doctor blade 3360.

The device substrate 200*a* is then introduced to a nip 3150 defined between the casting cylinder 3100 and first impression roller 3200, such that the material on the casting cylinder is transferred to the device substrate 200*a*. Having been formed into the correct surface relief structure, the curable material is cured by exposing it to appropriate curing energy such as radiation R from a source 3500. This preferably takes place while the curable material is in contact with the surface relief of the casting cylinder, although if the material is already sufficiently viscous this could be performed after separation. In the example shown, the material is irradiated through the device substrate 200*a*, although the source 3500 could alternatively be positioned above the device substrate 200*a*, e.g. inside cylinder 3100 if the cylinder is formed from a suitable transparent material such as quartz.

The device substrate, now comprising the cured light control layer material, passes through second nip 3160 defined by second impression roller 3300, and the light control layer, now affixed to the colour shifting element of the device, separates from the casting cylinder such that device 200 is formed. It will be appreciated that an appropriate registering of the applicators 3310, 3320, and the provision of the device substrate 200*a* is required in order to provide the desired functional regions A and B of the light control layer.

Figure 7:
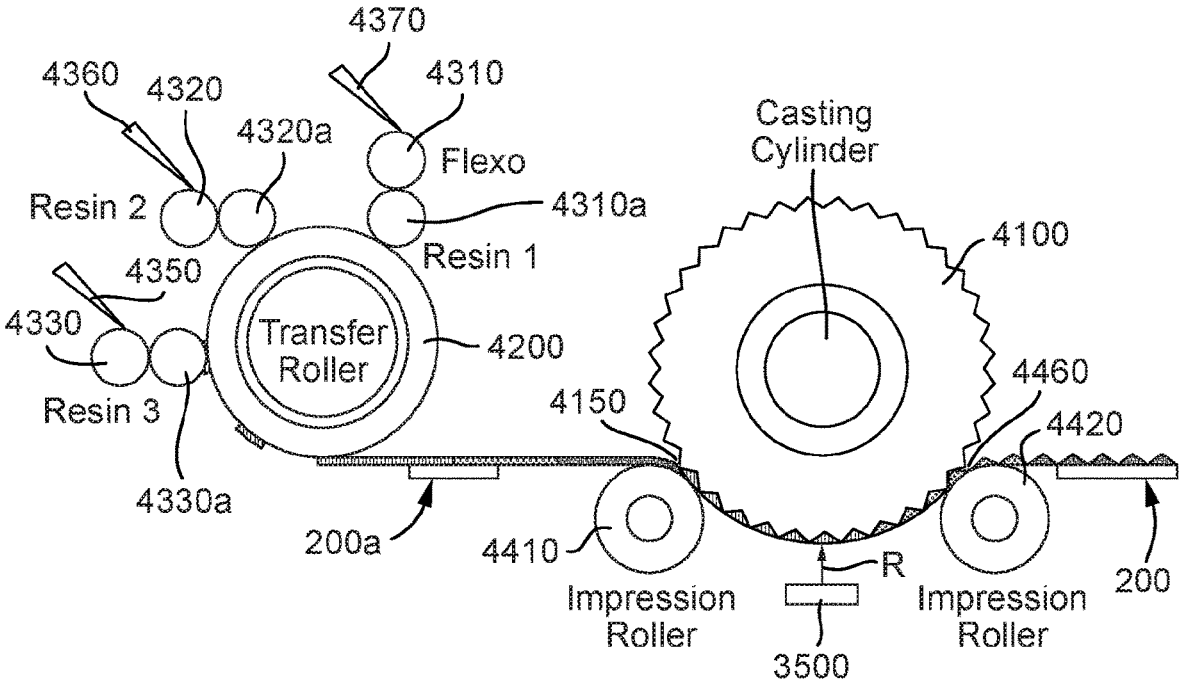

FIG. 7 illustrates a further example of manufacturing such a security device using a flexographic process, and illustrates how the light control layer may comprise three different materials (for example as illustrated in FIG. 4*a*). Here, device substrate 200*a* is provided to a transfer roller 4200, where first, second and third suitable curable materials are provided, in appropriate register, by first, second and third applicator rollers 4310, 4320, 4330 via respective annilox rollers 4310*a*, 4320*a* and 4330*a*. The first, second and third curable materials have different refractive indices and correspond to the functional regions A, B and C. Doctor blades (illustrated at 4350, 4360 and 4370) may optionally be used to remove excess material from the applicator rollers. Optionally, doctor blades may be used to remove excess material from the annilox rollers. The device substrate 200*a*, now comprising the curable material, is subsequently introduced to casting cylinder 4100, wherein the outer surface of the casting cylinder comprises the inverse surface relief of the desired light control layer surface relief.

The device substrate 200*a* passes through first nip 4150 defined by impression roller 4410 and casting cylinder to form the surface relief of the light control layer in the curable material, wherein subsequently the curable material is cured by radiation R in the same manner as described above in relation to FIG. 6. This preferably takes place while the curable material is in contact with the surface relief of the casting cylinder, although if the material is already sufficiently viscous this could be performed after separation. In the example shown, the material is irradiated through the device substrate 200*a*, although the source 3500 could alternatively be positioned above the device substrate 200*a*, e.g. inside cylinder 4100 if the cylinder is formed from a suitable transparent material such as quartz.

The device substrate, now comprising the cured light control layer material, passes through second nip 4460 defined by second impression roller 4420, and the light control layer, now affixed to the colour shifting element of the device, separates from the casting cylinder such that device 200 is formed.

Figure 8:
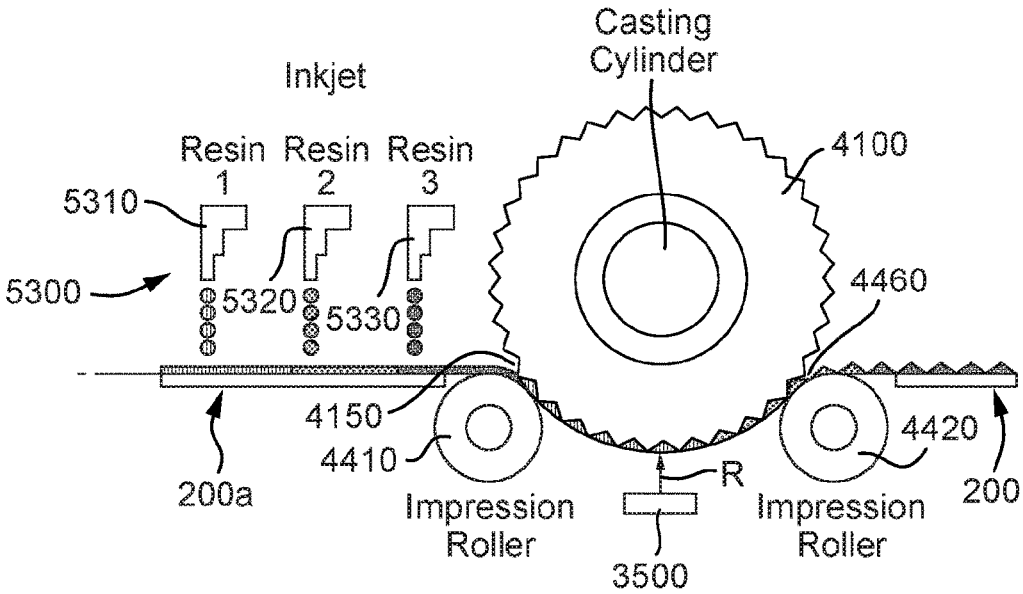

FIG. 8 shows a further example of manufacturing such a security device, this time using inkjet printing, and again illustrates how the light control layer may comprise three different materials (for example as illustrated in FIG. 4*a*). Here, device substrate 200*a* is presented to a print head 5300, here depicted as comprising three material applicators 5310, 5320 and 5330. However, it will be appreciated that such a print head may be capable of printing more than three, or fewer than three, different materials. The print head is used to provide the curable materials to the device substrate in appropriate register, before the device substrate 200*a*, now comprising the curable material, is subsequently introduced to casting cylinder 4100, wherein the outer surface of the casting cylinder comprises the inverse surface relief of the desired light control layer surface relief. The material is cured and the security device 200 is formed in the same way as described above in FIGS. 6 and 7.

Figure 6:
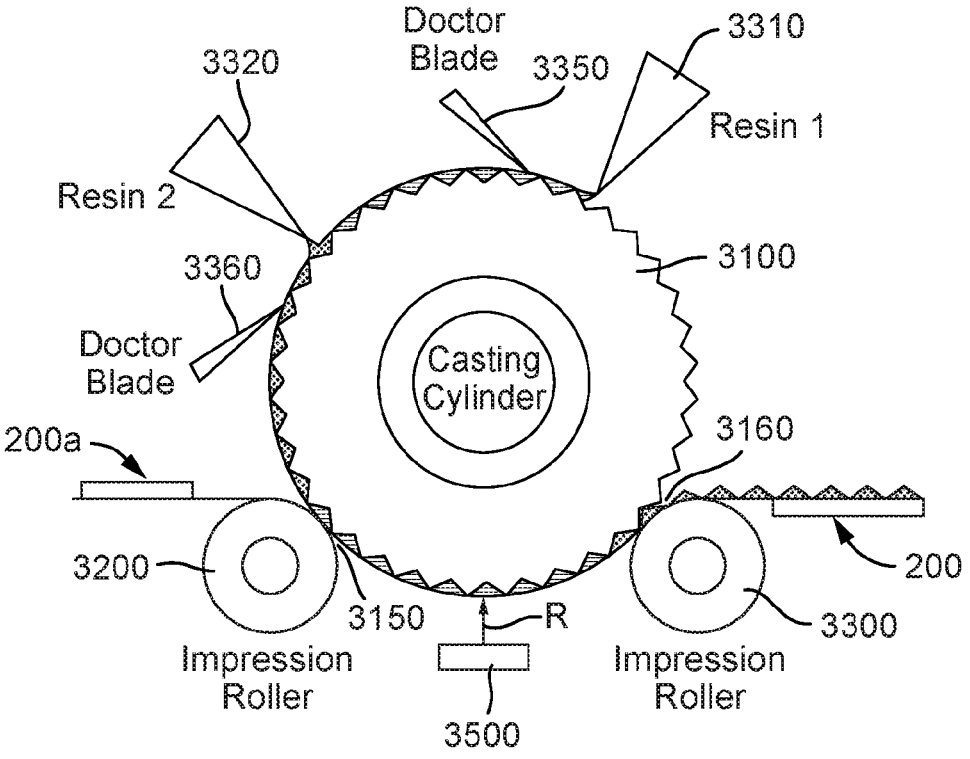
FIGS. 6, 7 and 8 illustrate example methods of manufacturing a security device according to the invention.

Different "tints" in FIGS. 6, 7 and 8 have been used to schematically represent different refractive indices of light control layer material.

The use of inkjet printing advantageously allows the arrangement of the curable materials to be changed quickly and easily. For example, one security device may be printed so as the functional regions exhibit a first indicia, and a different security device may be printed to as to exhibit a second, different indicia. This has particular advantages in personalising security devices.

In each of the examples described above, the different curable materials of the light control layer are cured substantially simultaneously. However, it is envisaged that in some embodiments, a first curable material is applied and cured, and then subsequently a second curable material is applied and cured.

The radiation used to effect curing is typically UV radiation but could comprise electron beam, visible, or even infra-red or higher wavelength radiation, depending upon the material, its absorbance and the process used. Examples of suitable curable materials include UV curable acrylic based clear embossing lacquers or those based on other compounds such as nitro-cellulose.

The curable material could be elastomeric and therefore of increased flexibility. An example of a suitable elastomeric curable material is aliphatic urethane acrylate (with suitable cross-linking additive such as polyaziridine). Further examples of suitable materials for the light control layer were set out above in the summary of the invention section.

Subsequent to the manufacturing of the device, the polymer carrier substrate may be removed.

Security devices of the sort described above can be incorporated into or applied to any article for which an authenticity check is desirable. In particular, such devices may be applied to or incorporated into documents of value such as banknotes, passports, driving licences, cheques, identification cards etc.

The security device or article can be arranged either wholly on the surface of the base substrate of the security document, as in the case of a stripe or patch, or can be visible only partly on the surface of the document substrate, e.g. in the form of a windowed security thread. Security threads are now present in many of the world's currencies as well as vouchers, passports, travellers' cheques and other documents. In many cases the thread is provided in a partially embedded or windowed fashion where the thread appears to weave in and out of the paper and is visible in windows in one or both surfaces of the base substrate. One method for producing paper with so-called windowed threads can be found in EP-A-0059056. EP-A-0860298 and WO-A-03095188 describe different approaches for the embedding of wider partially exposed threads into a paper substrate. Wide threads, typically having a width of 2 to 6 mm, are particularly useful as the additional exposed thread surface area allows for better use of optically variable devices, such as that presently disclosed.

The security device or article may be subsequently incorporated into a paper or polymer based substrate so that it is viewable from both sides of the finished security substrate. Methods of incorporating security elements in such a manner are described in EP-A-1141480 and WO-A-03054297. In the method described in EP-A-1141480, one side of the security element is wholly exposed at one surface of the substrate in which it is partially embedded, and partially exposed in windows at the other surface of the substrate.

Base substrates suitable for making security substrates for security documents may be formed from any conventional materials, including paper and polymer. Techniques are known in the art for forming substantially transparent regions in each of these types of substrate. For example, WO-A-8300659 describes a polymer banknote formed from a transparent substrate comprising an opacifying coating on both sides of the substrate. The opacifying coating is omitted in localised regions on both sides of the substrate to form a transparent region. In this case the transparent substrate can be an integral part of the security device or a separate security device can be applied to the transparent substrate of the document, WO-A-0039391 describes a method of making a transparent region in a paper substrate. Other methods for forming transparent regions in paper substrates are described in EP-A-723501, EP-A-724519, WO-A-03054297 and EP-A-1398174.

The security device may also be applied to one side of a paper substrate so that portions are located in an aperture formed in the paper substrate. An example of a method of producing such an aperture can be found in WO-A-03054297. An alternative method of incorporating a security element which is visible in apertures in one side of a paper substrate and wholly exposed on the other side of the paper substrate can be found in WO-A-2000/39391.

Examples of such documents of value and techniques for incorporating a security device will now be described with reference to FIGS. 9 to 12.

Figure 9A:
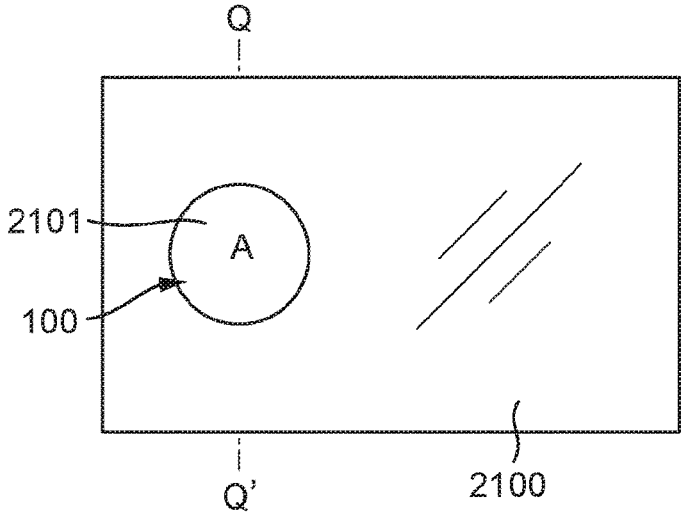
FIGS. 9 to 13 illustrate example security documents incorporating a security device according to the invention.
Figure 9B:
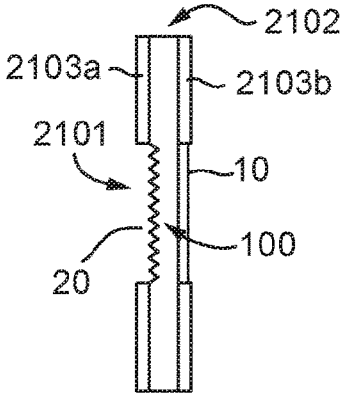

FIG. 9 depicts an exemplary document of value 2100, here in the form of a banknote. FIG. 9*a* shows the banknote in plan view whilst FIG. 9*b* shows the same banknote in cross-section along the line Q-Q'. In this case, the banknote is a polymer (or hybrid polymer/paper) banknote, having a transparent substrate 2102. Two opacifying layers 2103*a* and 2103*b* are applied to either side of the transparent substrate 2102, which may take the form of opacifying coatings such as white ink, or could be paper layers laminated to the substrate 2102.

The opacifying layers 2103*a* and 2103*b* are omitted across an area 2101 which forms a window within which the security device 100 is located. As shown best in the cross-section of FIG. 9*b*, a colour shifting element 10 is provided on one side of the transparent substrate 2102, and a light control layer 20 is provided on the opposite surface of the substrate such that light incident upon the security device is refracted at the light control layer 20 before reaching the colour shifting element (however, the colour shifting element and the light control layer may alternatively be provided on the same side of the substrate). The colour shifting element 10 and light control layer 20 are each as described above with respect to any of the disclosed embodiments, such that the device 100 displays an optically variable effect in window 2101 upon tilting the device (an image of the letter "A" is depicted here as an example, exhibited at at least one viewing angle). In the example shown in FIG. 9, the light control layer comprises as least a region having a first refractive index and a second region having a second refractive index different to the first refractive index.

The device 100 may be viewed in transmission or reflection. In the case where it is to be viewed in reflection it is desirable to use a substantially opaque colour shifting element such as a printed ink comprising an optically variable pigment, although a partially transparent colour shifting element may be used in conjunction with an absorbing element as described above. It should be noted that in modifications of this embodiment the window 2101 could be a half-window with the opacifying layer 2103*b* continuing across all or part of the window over the colour shifting element 10. The banknote may also comprise a series of windows or half-windows. In this case different areas displayed by the security device could appear in different ones of the windows, at least at some viewing angles, and could move from one window to another upon tilting.

Figure 10A:
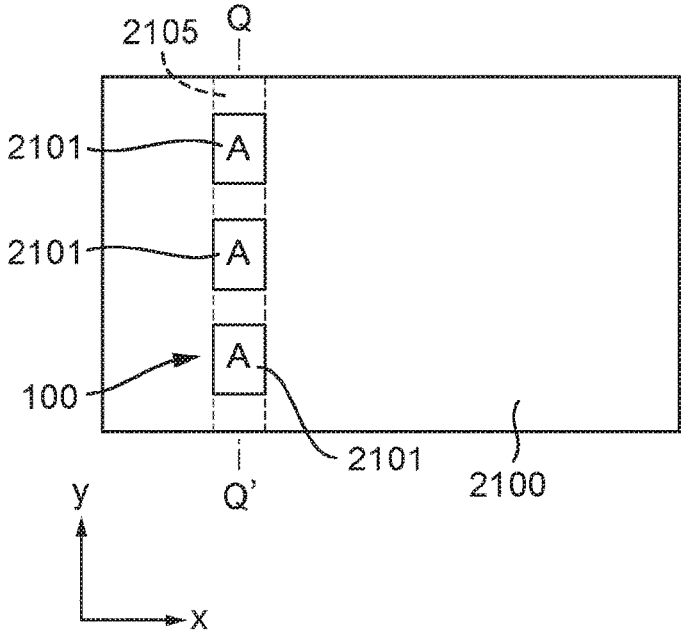
Figure 10B:
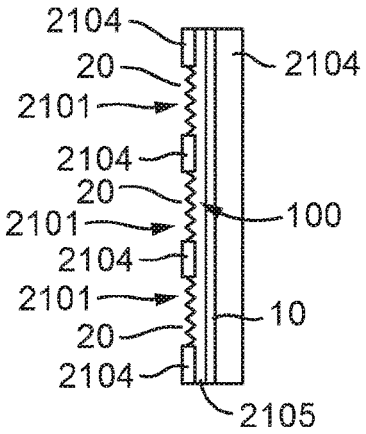

FIG. 10 shows such an example, although here the banknote 2100 is a conventional paper-based banknote provided with a security article 2105 in the form of a security thread, which is inserted during paper-making such that it is partially embedded into the paper so that portions of the paper 2104 lie on either side of the thread. This can be done using the techniques described in EP0059056 where paper is not formed in the window regions during the paper making process thus exposing the security thread in is incorporated between layers of the paper. The security thread 2105 is exposed in window regions 2101 of the banknote. Alternatively the window regions 2101 may for example be formed by abrading the surface of the paper in these regions after insertion of the thread. The security device 100 is formed on the thread 2105, which comprises a transparent substrate with light control layer 20 provided on one side and a colour shifting element 10 provided on the other. In the illustration of FIG. 10(*b*) the colour shifting element is provided continuously along one side of the thread 2105 and the light control layer is depicted as being discontinuous between each exposed region of the thread. However, in practice typically this will not be the case and the security device 100 will be formed continuously along the thread.

If desired, several different security devices 100 could be arranged along the thread, with different optical effects displayed by each. In one example, a first window could contain a first security device, and a second window could contain a second security device, both devices having light control layer surface reliefs comprising linear microprisms, with the linear microprisms of each device arranged along different (preferably orthogonal) directions, so that the two windows display different effects upon tilting in any one direction. For instance, the central window may be configured to exhibit a colour change effect when the document 100 is tilted about the x axis whilst the devices in the top and bottom windows remain uniform in colour, and vice versa when the document is tilted about the y axis. The light control layers of the security devices may have different arrangements (e.g. refractive indices) such that different windows appear different colours upon tilting.

Figure 11A:
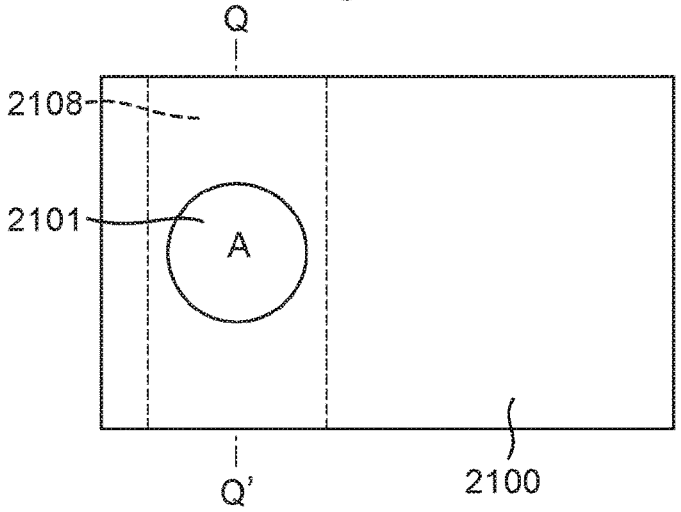
Figure 11B:
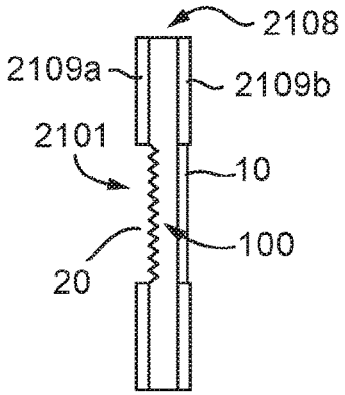

In FIG. 11, the banknote 2100 is again a conventional paper-based banknote, provided with a strip element or insert 2108. The strip 2108 is based on a transparent substrate and is inserted between two plies of paper 2109*a* and 2109*b*. The security device 100 is formed by a light control layer 20 on one side of the strip substrate, and a colour shifting element 10 on the other. The paper plies 2109*a* and 2109*b* are apertured across region 2101 to reveal the security device 100, which in this case may be present across the whole of the strip 2108 or could be localised within the aperture region 2101. The colour shifting element 10 is visible through the light control layer 20 due to the transparent nature of the strip 2108.

Figure 12A:
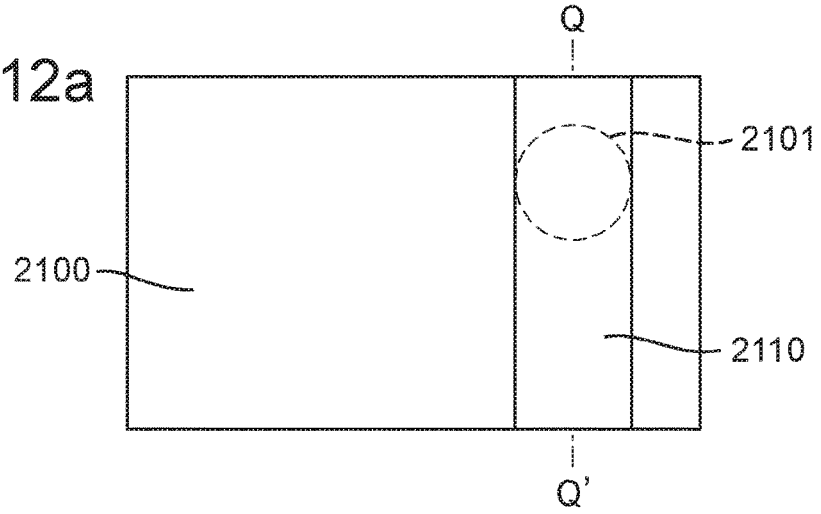
Figure 12B:
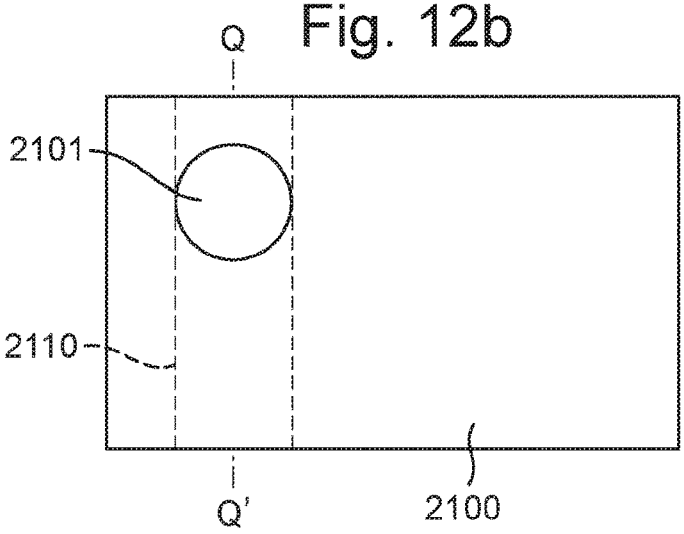
Figure 12C:
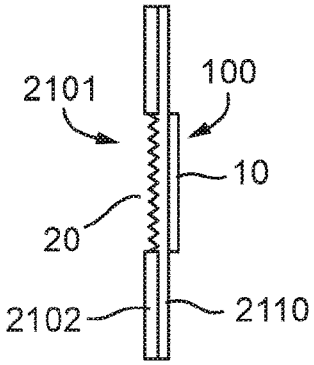

A further embodiment is shown in FIG. 12 where FIGS. 12(*a*) and (*b*) show the front and rear sides of the document 2100 respectively, and FIG. 12(*c*) is a cross section along line Q-Q'. Security article 2110 is a strip or band comprising a security device 100 according to any of the embodiments described above. The security article 2110 is formed into a security document 2100 comprising a fibrous substrate 2102, using a method described in EP-A-1141480. The strip is incorporated into the security document such that it is fully exposed on one side of the document (FIG. 12(*a*)) and exposed in one or more windows 2101 on the opposite side of the document (FIG. 12(*b*)). Again, the security device is formed on the strip 2110, which comprises a transparent substrate with a light control layer 20 formed on one surface and colour shifting element 10 formed on the other.

In FIG. 12, the document of value 2100 is again a conventional paper-based banknote and again includes a strip element 2110. In this case there is a single ply of paper. Alternatively a similar construction can be achieved by providing paper 2102 with an aperture 2101 and adhering the strip element 2110 on to one side of the paper 2102 across the aperture 2101. The aperture may be formed during papermaking or after papermaking for example by die-cutting or laser cutting. Again, the security device is formed on the strip 2110, which comprises a transparent substrate with a light control layer 20 formed on one surface and a colour shifting element 10 formed on the other.

In the examples of FIGS. 9 to 12, the colour shifting element and light control layer are described as being on opposing sides of a transparent substrate. However in other examples they may be provided on the same side of the transparent substrate.

Figure 13A:
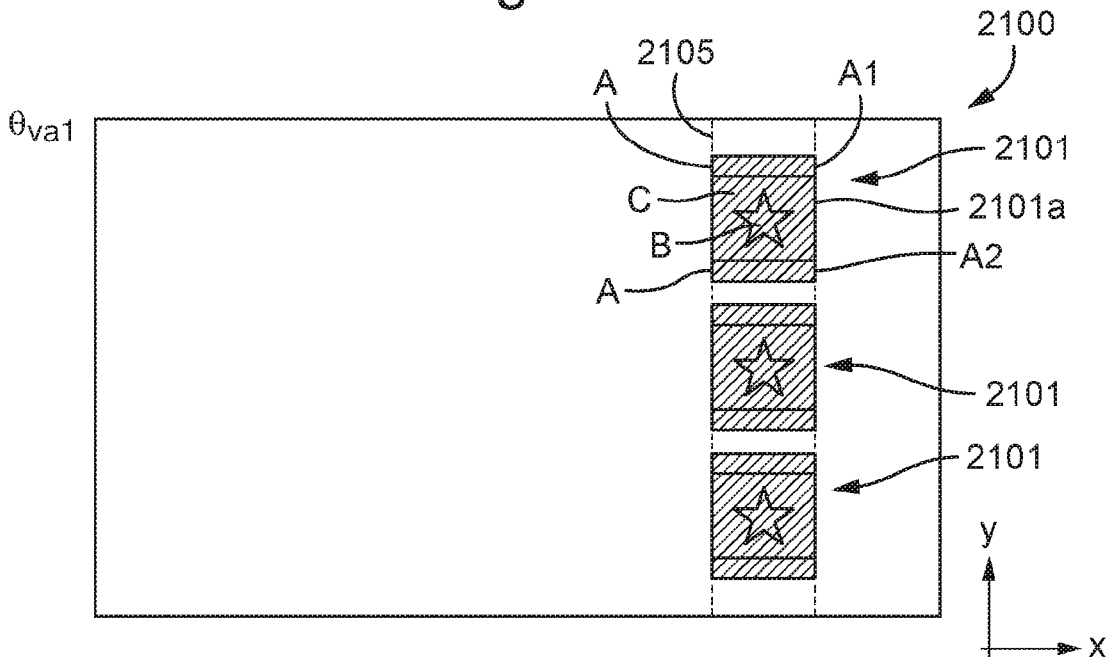
Figure 13B:
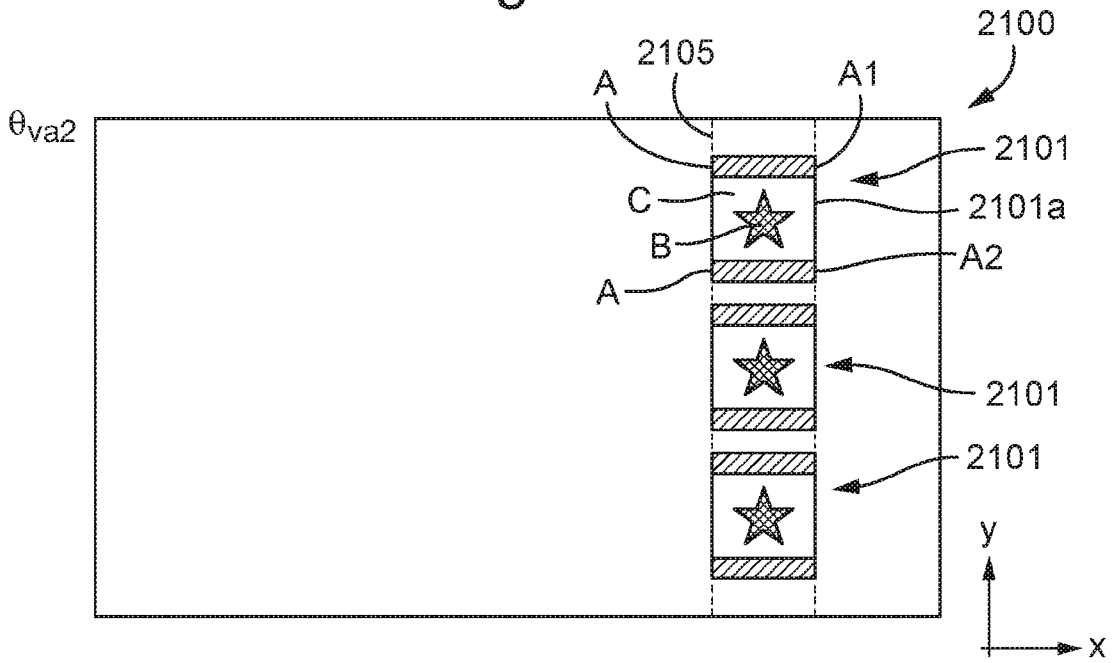

FIGS. 13*a* and 13*b* illustrate an example security document in the form of a banknote 2100 in more detail. The banknote is provided with a security thread 2105 as described above, with the thread being exposed in window regions 2101 of the banknote substrate. The banknote substrate may be paper or polymer. In this example each exposed window region 2101 exhibits the same visual effect and so we will consider window 2101*a* only for ease of description. Here, a security device is provided comprising a black (wavelength of reflected light in the IR region of the EM spectrum) to red colour shifting element as has been described above. The security device also comprises a light control layer comprising an array of linear triangular microprisms having their long axes in a direction substantially parallel to the long axis of the banknote substrate (here the x axis). A first functional region A of the light control layer (which is split into two sub-regions A1 and A2) is formed such that the microprisms in said region have a first refractive index. A second functional region B of the light control layer defining a star indicia is formed such that the microprisms in said functional region have a second refractive index different to the first refractive index. A region C of the device comprises colour shifting element that is not covered by the light control layer. An absorbing layer is provided contiguously beneath the colour shifting element such that the visual effects of the device are intended to be viewed in reflection.

Therefore, at a normal angle of viewing $\Theta_{va1}$, functional regions A and B, and region C all exhibit a black colour such that the different regions are not discernible. This is schematically illustrated by the uniform shading in FIG. 13*a*. Upon tilting the device about an axis parallel with the x axis and viewing at an angle $\Theta_{va2}$, the different regions A, B and C reveal themselves due to them exhibiting different colours, as schematically illustrated in FIG. 13*b*. More specifically, region C will appear red due to the effect of the colour shifting element, and functional regions A and B will appear different colours due to the effect of the light control layer in combination with the colour shifting element. As discussed above, functional regions A and B will exhibit different colours due to their differing refractive indices.

In some embodiments, a security device according to any of the embodiments described above may be incorporated into a security document in the form of a polycarbonate data page, for example for a passport or identity card. Such a security device may be affixed to the surface of the data page, for example through the use of a pressure-sensitive adhesive. Alternatively, it is envisaged that the surface relief of the light control layer of the device may be formed as part of the polycarbonate page itself.

Figure 14:
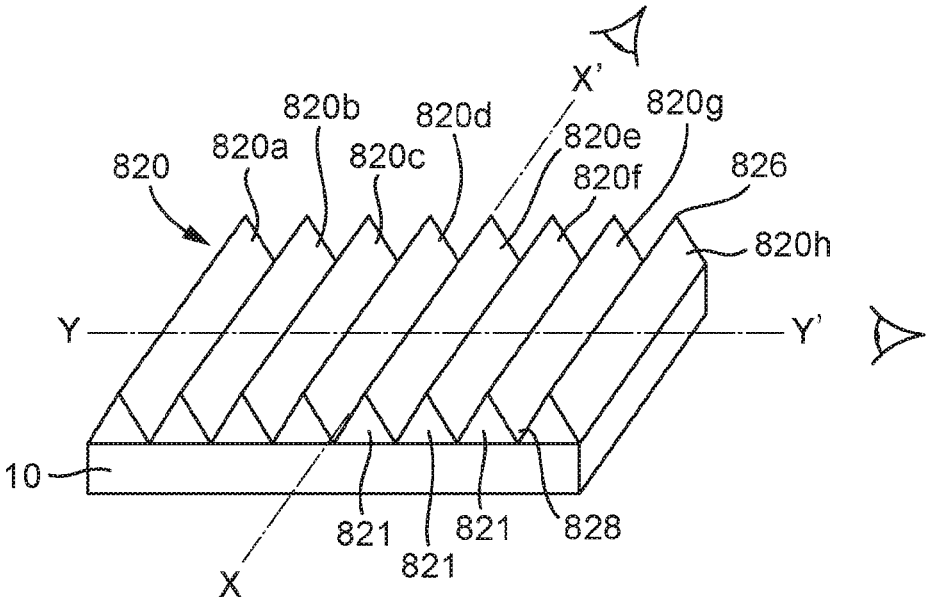
FIGS. 14 to 21 illustrate example light control layers that may be used in a security device according to the invention.

The above embodiments have been described with respect to the light control layer comprising a microprismatic structure comprising a plurality of linear microprisms. FIG. 14 is an aerial perspective view of such a functional region, shown generally at 820. The microprismatic structure comprises an array of linear microprisms 820*a*, 820*b* . . . 820*h* each having a symmetrical triangular cross section (shown generally at 821). The linear microprisms substantially abut each other along their long axes, and are parallel with each other about their long axes. The array of microprisms defines a surface relief.

Opposing end faces of an individual microprism are substantially parallel, and such a microprism is known as a "one-dimensional" microprism. The microprismatic structure 820 shown in FIG. 14 is therefore a one-dimensional microstructure as it comprises a plurality of one-dimensional microprisms. The term "one-dimensional" is used because the optical effect produced by the microprism is significantly stronger (i.e. more noticeable to a viewer) in one direction of viewing. In the example of FIG. 14, the effect of the surface relief is most noticeable if viewed along a direction Y-Y' perpendicular to the long axes of the microprisms.

The optical effect exhibited by the light control layer is therefore anisotropic. If the security device comprising the light control layer is rotated within its plane, the exhibited optical effect due to the combination of colour shifting element and light control layer is seen most readily when the device is tilted with the viewing direction perpendicular to the long axes of the microprisms (i.e. along Y-Y'). If the device is rotated such that the viewing direction is parallel with the long axes of the microprisms (i.e. along X-X'), the effect is seen to a lesser extent.

A variety of different functional region surface relief structures can be used for a security device light control layer according to the present invention, as will be highlighted with reference to the following FIGS. 15 to 21.

Figure 15:
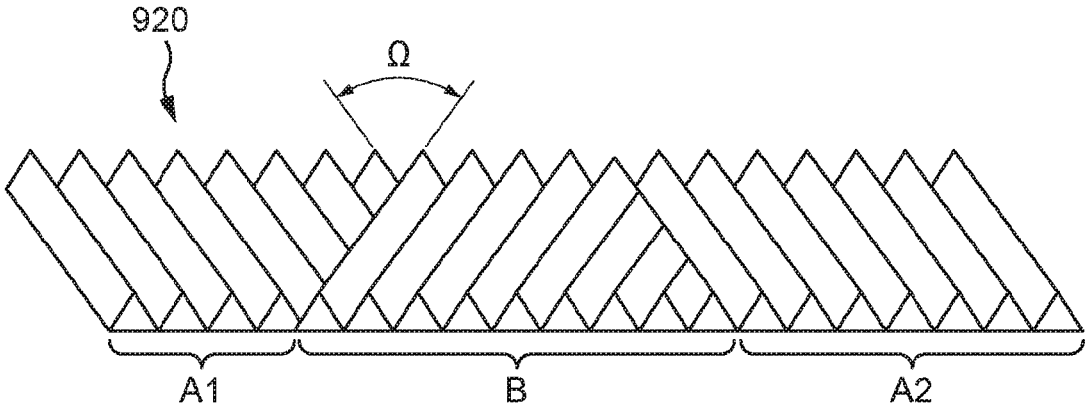

FIG. 15 illustrates an example light control layer 920 that comprises three functional regions A1, B and A2, each comprising a plurality of microprisms. The microprisms in each functional region are parallel with each other, and the microprisms of functional regions A1 and A2 are parallel. However, the microprisms of functional region B are offset from those of functional regions A1 and A2, such that the long axes of the microprisms of functional regions A1 and A2 define an angle Ω with the long axes of functional region B. Thus, the light control layer 920 will provide a modifying optical effect when tilted and viewed along a direction perpendicular to the long axes of the microprisms of functional regions A1 and A2, as well as a readily seen optical effect when light control layer 920 is rotated and viewed from a direction perpendicular to the long axes of functional region B. This is in contrast to the surface relief of FIG. 16, where the long axes of the microprisms are aligned in a single direction.

Figure 16:
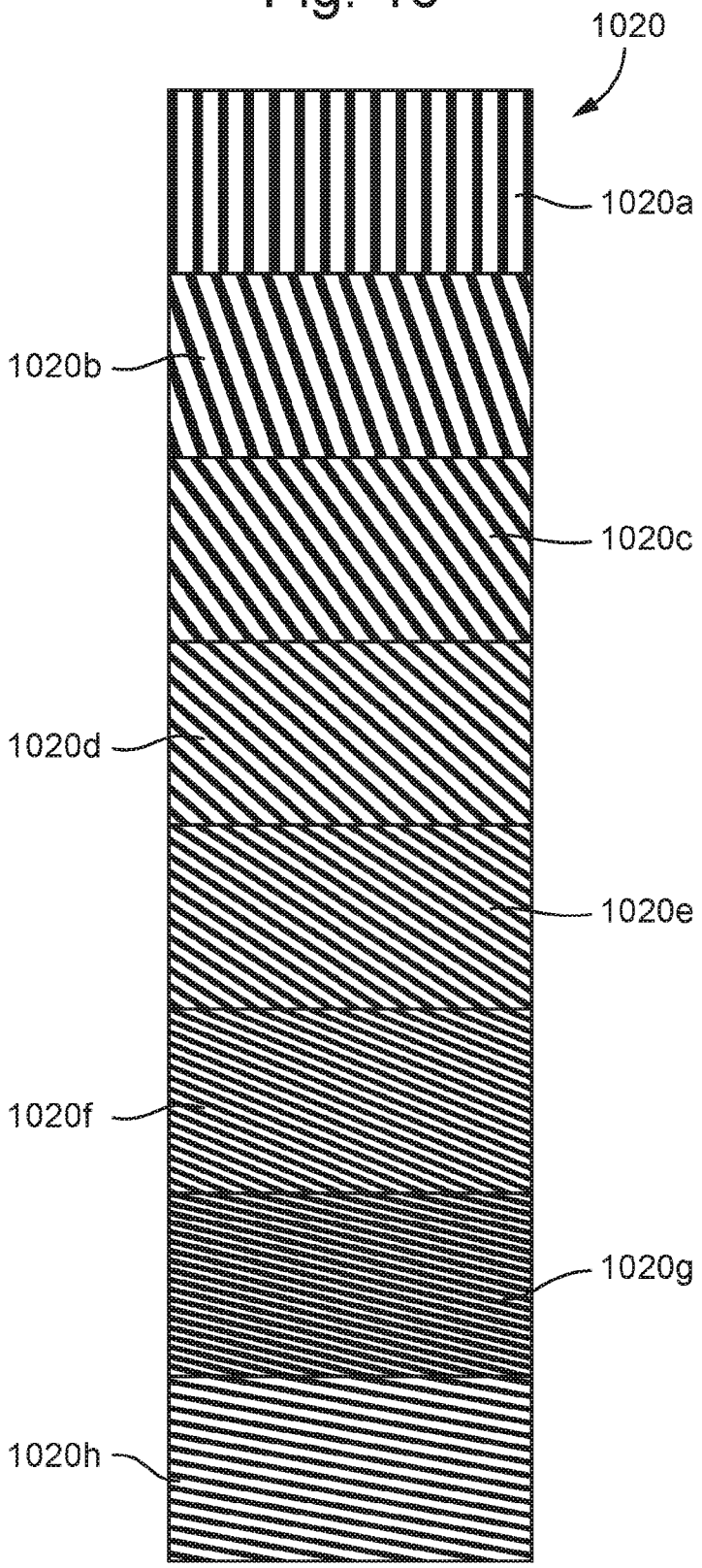

It is envisaged that a light control layer may comprise a plurality of functional regions offset from each other can be used, as shown in FIG. 16. FIG. 16 schematically illustrates a light control layer 1020 comprising a plurality of linear microprisms arranged in a plurality of arrays 1020*a*, 1020*b* . . . 1020*h* rotationally offset to each other.

Figure 17:
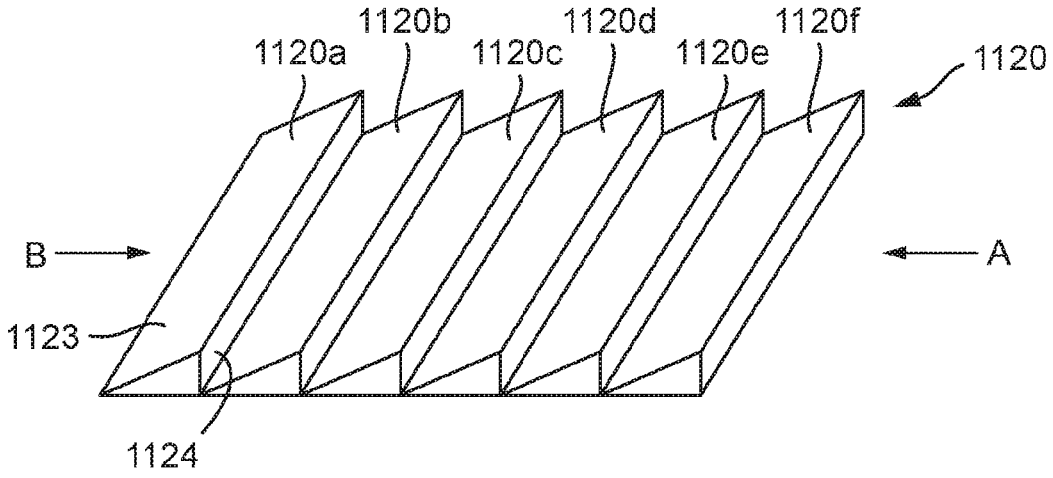

FIG. 17 illustrates a light control layer 1120 comprising a plurality of microprisms 1020*a*, 1020*b* . . . 1020*f* each having a "saw-tooth" structure, in that one facet (shown here at 1123) defines a more acute angle with the outer surface of the colour shifting element than the other facet of the microprism (shown at 1124). Such a saw-tooth structure, when viewed from direction A, will provide a colour shift effect that occurs over a narrow angle of tilt. Conversely, when viewed from direction B, the colour shift occurs over a relatively large angle of tilt.

Figure 18:
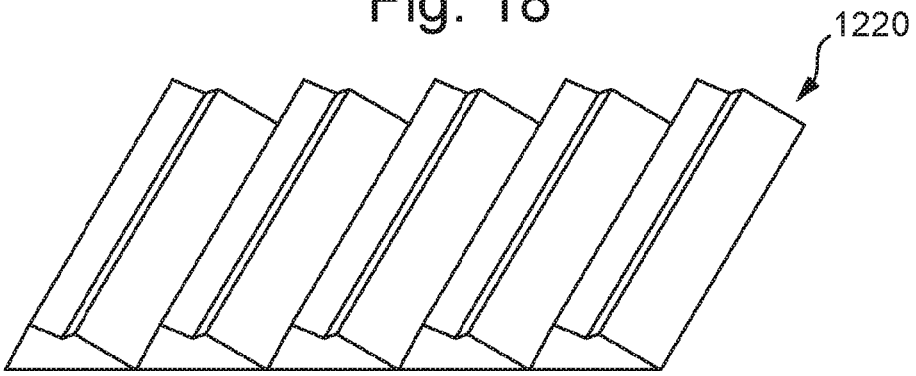
Figure 19:
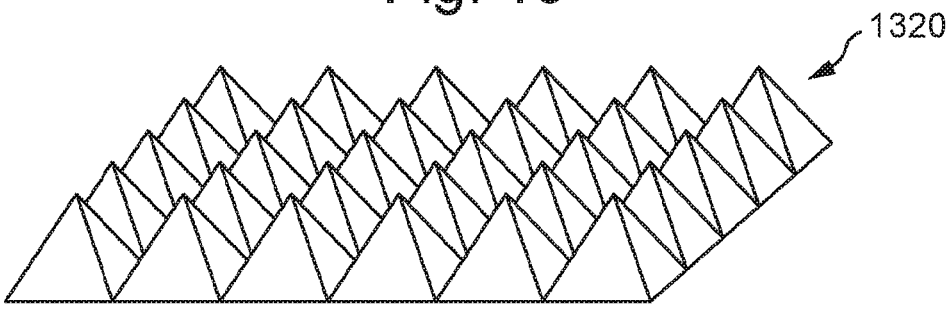
Figure 20:
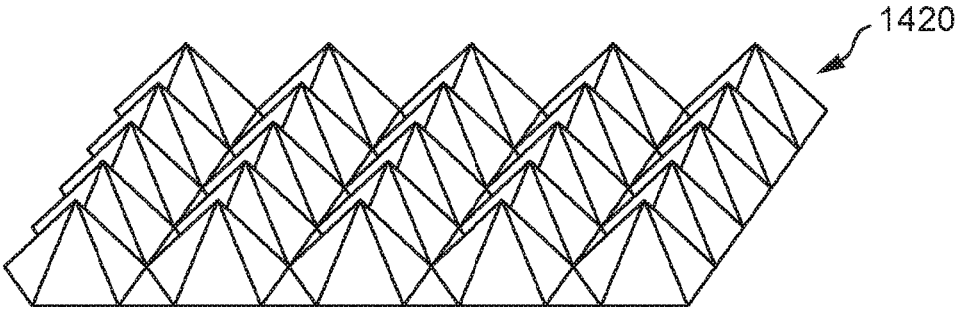

The light control layer may comprise a series of multi-faceted microprisms (i.e. having more than two facets), as shown in the surface relief 1120 of FIG. 18.

To obtain more isotropy in the optical properties of the light control layer, a "two-dimensional" microprismatic structure may be used comprising microprisms that are not as rotationally dependent as the linear microprisms of FIG. 18 for example. Such examples include corner cubes, square based pyramid microprisms as depicted in the light control layer 1320 of FIG. 19, or more generally polygon-based pyramidal microprisms such as the hexagonal based pyramidal microprisms seen in the light control layer 1420 of FIG. 20.

Figure 21:
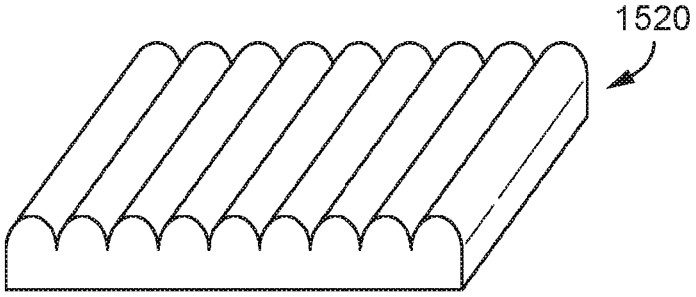

FIG. 21 depicts a light control layer 1520 which has a structure similar to a microprismatic structure, but instead of microprisms comprises an array of lecticules with a domed surface structure.

The invention claimed is:

1. A security device comprising:

a colour shifting element that exhibits different colours dependent on an angle of incidence of light impinging upon the colour shifting element; and an at least partially transparent light control layer covering at least a part of the colour shifting element and comprising at least first and second functional regions, and a surface relief on an outwardly facing surface of the light control layer in each of the first and second functional regions, the surface relief being adapted to modify the angle of light incident upon the light control layer, wherein:

the at least first and second functional regions have different refractive indices such that light incident upon the first functional region impinges upon the colour shifting element at a first angle of incidence, and light incident upon the second functional region impinges upon the colour shifting element at a second, different, angle of incidence.

2. The security device of claim 1, wherein the surface relief of the light control layer is further adapted to modify the angle of light from the colour shifting element.

3. The security device of claim 1, wherein, at least at one viewing angle, the first and second functional regions exhibit different colours.

4. The security device of claim 1, wherein the first and second functional regions comprise substantially the same surface relief.

5. The security device of claim 1, wherein at least one of the first and second functional regions defines indicia.

6. The security device of claim 1, wherein the surface relief comprises at least one microstructure.

7. The security device of claim 6, wherein the microstructure is a linear microprism and the surface relief comprises an array of linear microprisms.

8. The security device of claim 7, wherein the microprisms have an asymmetrical structure.

9. The security device of claim 7, wherein the microprisms have a repeating faceted structure.

10. The security device of claim 6, wherein the surface relief comprises two or more arrays of linear microprisms, wherein the long axes of one array are angularly offset from the axes of the other array.

11. The security device of claim 6, wherein the microstructure is a one dimensional microstructure.

12. The security device of claim 6, wherein the microstructure is a two dimensional microstructure.

13. The security device of claim 6, wherein the microstructure is a lenticule having a curved surface structure and the surface relief comprises a lenticule array.

14. A security article or security document comprising a security device according to claim 1.

15. A method of manufacturing a security device, the method comprising:

providing an at least partially transparent light control layer so as to cover at least a part of a colour shifting element that exhibits different colours dependent on an angle of incidence of light impinging upon the colour shifting element, wherein:

the light control layer comprises first and second functional regions, and a surface relief on an outwardly facing surface of the light control layer in each of the first and second functional regions, the surface relief being adapted to modify the angle of light incident upon the light control layer, and the at least first and second functional regions have different refractive indices such that light incident upon the first functional region impinges upon the colour shifting element at a first angle of incidence, and light incident upon the second functional region impinges upon the colour shifting element at a second, different, angle of incidence.

16. The method of claim 15, wherein the material of the light control layer is provided by at least one of intaglio printing, gravure, flexo printing, inkjet printing, knife coating, curtain or blade techniques.

17. The method of claim 15, wherein the surface relief of the light control layer is formed by one of embossing, extrusion or cast curing.

18. The method of claim 15, wherein the first and second functional regions comprise substantially the same surface relief.

19. The method of claim 15, wherein the surface relief comprises at least one microstructure.

20. The method of claim 19, wherein the microstructure is a linear microprism and the surface relief comprises an array of linear microprisms.

* * * * *